US010773521B2

(12) United States Patent
Ito

(10) Patent No.: US 10,773,521 B2
(45) Date of Patent: Sep. 15, 2020

(54) CABLE GROUP AND CABLE

(71) Applicant: SEIKO EPSON CORPORATION, Tokyo (JP)

(72) Inventor: Sukehiro Ito, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/413,745

(22) Filed: May 16, 2019

(65) Prior Publication Data

US 2019/0351679 A1 Nov. 21, 2019

(30) Foreign Application Priority Data

May 18, 2018 (JP) ..... 2018-095926

(51) Int. Cl.
*B41J 2/14* (2006.01)

(52) U.S. Cl.
CPC .. *B41J 2/14201* (2013.01); *B41J 2002/14491* (2013.01)

(58) Field of Classification Search
CPC .. B41J 2/17526; B41J 2/1753; B41J 2/17546; B41J 2/14072; B41J 2/04516; B41J 2002/14491
See application file for complete search history.

(56) References Cited

U.S. PATENT DOCUMENTS

2003/0146954 A1 8/2003 Tamura
2011/0141196 A1* 6/2011 Oikawa ..... B41J 2/14072
2016/0144631 A1* 5/2016 Takagi ..... B41J 2/14072

FOREIGN PATENT DOCUMENTS

JP 2003-226006 A 8/2003

* cited by examiner

*Primary Examiner* — Juanita D Jackson
(74) *Attorney, Agent, or Firm* — Global IP Counselors, LLP

(57) ABSTRACT

The second terminal is disposed between the first terminal and the third terminal. The fifth terminal is disposed between the fourth terminal and the sixth terminal. The first cable and the second cable are disposed to at least partially overlap with each other in a direction orthogonal to a direction in which the first terminal and the second terminal are lined up.

6 Claims, 20 Drawing Sheets

| [SIH, SIL] | T1 | | T2 | |
|---|---|---|---|---|
| | Sa | Sb | Sa | Sb |
| [1, 1] : LARGE DOT | H | L | H | L |
| [1, 0] : MEDIUM DOT | H | L | L | H |
| [0, 1] : SMALL DOT | L | L | L | H |
| [0, 0] : NO RECORDING | L | H | L | L |

FIG. 15

| CABLE 19c | | | PROPAGATED SIGNAL |
|---|---|---|---|
| TERMINAL NUMBER ON DRIVE CIRCUIT SUBSTRATE SIDE | WIRE NUMBER | TERMINAL NUMBER ON HEAD SUBSTRATE SIDE | |
| 195c-1 | 197c-1 | 196c-1 | GND |
| 195c-2 | 197c-2 | 196c-2 | COMA1 |
| 195c-3 | 197c-3 | 196c-3 | VBS1 |
| 195c-4 | 197c-4 | 196c-4 | COMB2 |
| 195c-5 | 197c-5 | 196c-5 | VBS2 |
| 195c-6 | 197c-6 | 196c-6 | COMA3 |
| 195c-7 | 197c-7 | 196c-7 | VBS3 |
| 195c-8 | 197c-8 | 196c-8 | COMB4 |
| 195c-9 | 197c-9 | 196c-9 | VBS4 |
| 195c-10 | 197c-10 | 196c-10 | COMA5 |
| 195c-11 | 197c-11 | 196c-11 | VBS5 |
| 195c-12 | 197c-12 | 196c-12 | COMB6 |
| 195c-13 | 197c-13 | 196c-13 | VBS6 |
| 195c-14 | 197c-14 | 196c-14 | VDD |

FIG. 16

| CABLE 19d | | | PROPAGATED SIGNAL |
|---|---|---|---|
| TERMINAL NUMBER ON DRIVE CIRCUIT SUBSTRATE SIDE | WIRE NUMBER | TERMINAL NUMBER ON HEAD SUBSTRATE SIDE | |
| 195d-1 | 197d-1 | 196d-1 | VHV |
| 195d-2 | 197d-2 | 196d-2 | VBS1 |
| 195d-3 | 197d-3 | 196d-3 | COMB1 |
| 195d-4 | 197d-4 | 196d-4 | VBS2 |
| 195d-5 | 197d-5 | 196d-5 | COMA2 |
| 195d-6 | 197d-6 | 196d-6 | VBS3 |
| 195d-7 | 197d-7 | 196d-7 | COMB3 |
| 195d-8 | 197d-8 | 196d-8 | VBS4 |
| 195d-9 | 197d-9 | 196d-9 | COMA4 |
| 195d-10 | 197d-10 | 196d-10 | VBS5 |
| 195d-11 | 197d-11 | 196d-11 | COMB5 |
| 195d-12 | 197d-12 | 196d-12 | VBS6 |
| 195d-13 | 197d-13 | 196d-13 | COMA6 |
| 195d-14 | 197d-14 | 196d-14 | GND |

CABLE GROUP AND CABLE

The present application is based on, and claims priority from JP Application Serial Number 2018-095926, filed May 18, 2018, the disclosure of which is hereby incorporated by reference herein in its entirety.

BACKGROUND

1. Technical Field

The present disclosure relates to a cable group and a cable.

2. Related Art

It is known that a piezoelectric element such as a piezo element is used in an ink jet printer that prints an image or a document by ejecting ink as a liquid. The piezoelectric element is disposed in correspondence with each of a plurality of nozzles in a print head. By driving each piezoelectric element in accordance with a drive signal, a predetermined amount of ink is ejected from the nozzle at a predetermined timing, and a dot is formed. From an electrical viewpoint, the piezoelectric element is a capacitive load such as a capacitor. Thus, it is necessary to supply a sufficient current in order to operate the piezoelectric element of each nozzle. Thus, the ink jet printer is configured such that the piezoelectric element is driven by causing a drive circuit to supply a high voltage drive signal amplified by an amplification circuit to the head.

For example, JP-A-2003-226006 discloses an ink jet printer that executes printing by applying a drive signal to an upper electrode for a piezoelectric element including the upper electrode and a lower electrode, controlling displacement of the piezoelectric element by controlling the drive signal, and ejecting ink based on the displacement. In the ink jet printer disclosed in JP-A-2003-226006, the drive signal applied to the upper electrode is applied to the piezoelectric element through two flexible flat cables.

In the ink jet printer in JP-A-2003-226006, a part of the ink ejected from a nozzle floats inside the ink jet printer as ink mist. When the ink mist clings to the flexible flat cable, a current path is caused between the wirings of the flexible flat cables through the ink mist. Consequently, the impedance between the wirings of the flexible flat cables may be changed.

When the high voltage drive signal is propagated through a plurality of flexible flat cables, the ink mist may unevenly cling to a specific flexible flat cable. When the ink mist unevenly clings to the specific flexible cable, and the current path is formed between the wirings of the flexible flat cables through the ink mist, a new concern arises such that the load of the drive circuit supplying the drive signal through the flexible flat cable to which the ink mist clings is increased, and heat emission of a specific drive circuit may be increased.

SUMMARY

According to an aspect of the present disclosure, there is provided a cable group electrically coupled to an ejecting head of a liquid ejecting apparatus. The ejecting head includes a first ejecting unit ejecting a liquid by driving a first piezoelectric element, a second ejecting unit ejecting a liquid by driving a second piezoelectric element, and a third ejecting unit ejecting a liquid by driving a third piezoelectric element. The cable group includes a first cable including a first terminal from which a first drive signal input into one end of the first piezoelectric element from a first drive circuit is output, a second terminal from which a second drive signal input into one end of the second piezoelectric element from a second drive circuit is output, and a third terminal from which a third drive signal input into one end of the third piezoelectric element from the first drive circuit is output, and a second cable including a fourth terminal from which a fourth drive signal input into one end of the first piezoelectric element from the second drive circuit is output, a fifth terminal from which a fifth drive signal input into one end of the second piezoelectric element from the first drive circuit is output, and a sixth terminal from which a sixth drive signal input into one end of the third piezoelectric element from the second drive circuit is output. The second terminal is disposed between the first terminal and the third terminal. The fifth terminal is disposed between the fourth terminal and the sixth terminal. The first cable and the second cable are disposed to at least partially overlap with each other in a direction orthogonal to a direction in which the first terminal and the second terminal are lined up.

In the cable group, the second cable may include a seventh terminal from which a first reference voltage signal input into another end of the first piezoelectric element is output, and an eighth terminal from which a second reference voltage signal input into another end of the second piezoelectric element is output. The eighth terminal may be disposed between the fourth terminal and the fifth terminal. The fourth terminal may be disposed between the seventh terminal and the eighth terminal. The first cable and the second cable may be disposed such that the first terminal and the seventh terminal at least partially overlap with each other, and the second terminal and the eighth terminal at least partially overlap with each other.

In the cable group, the first drive signal and the second drive signal may have different signal waveforms.

In the cable group, a maximum voltage of the first drive signal may be higher than a maximum voltage of the second drive signal.

According to another aspect of the present disclosure, there is provided a cable coupled to an ejecting head of a liquid ejecting apparatus. The ejecting head includes a first ejecting unit ejecting a liquid by driving a first piezoelectric element, a second ejecting unit ejecting a liquid by driving a second piezoelectric element, and a third ejecting unit ejecting a liquid by driving a third piezoelectric element. The cable includes a first terminal from which a first drive signal input into one end of the first piezoelectric element from a first drive circuit is output, a second terminal from which a second drive signal input into one end of the second piezoelectric element from a second drive circuit is output, and a third terminal from which a third drive signal input into one end of the third piezoelectric element from the first drive circuit is output. The second terminal is disposed between the first terminal and the third terminal.

The cable may further include a fourth terminal from which a fourth drive signal input into one end of the first piezoelectric element from the second drive circuit is output, a fifth terminal from which a fifth drive signal input into one end of the second piezoelectric element from the first drive circuit is output, a sixth terminal from which a sixth drive signal input into one end of the third piezoelectric element from the second drive circuit is output, a seventh terminal from which a first reference voltage signal input into another end of the first piezoelectric element is output, and an eighth terminal from which a second reference voltage signal input into another end of the second piezoelectric element is output. The fifth terminal may be disposed between the fourth terminal and the sixth terminal. The eighth terminal may be disposed between the fourth terminal and the fifth terminal. The fourth terminal may be disposed between the seventh terminal and the eighth terminal. In a direction orthogonal to a direction in which the first terminal and the second terminal are lined up, the first terminal and the seventh terminal may be disposed to at least partially overlap with each other, and the second terminal and the eighth terminal are disposed to at least partially overlap with each other.

BRIEF DESCRIPTION OF THE DRAWINGS

FIG. 15 is a diagram illustrating a specific example of a signal propagated through a cable.

FIG. 16 is a diagram illustrating a specific example of a signal propagated through a cable.

DESCRIPTION OF EXEMPLARY EMBODIMENTS

Hereinafter, exemplary embodiments of the present disclosure will be described using the drawings. The used drawings are for convenience of description. The embodiments described below do not unduly limit the content of the present disclosure disclosed in the claims. In addition, not all configurations described below are essential constituents of the present disclosure.

In the following description, a liquid ejecting apparatus in which a cable group and a cable of the present disclosure are used will be described as an example.

1. First Embodiment

1.1 Summary of Liquid Ejecting Apparatus

The liquid ejecting apparatus is an ink jet printer that forms a dot on a printing medium such as paper by ejecting ink (liquid) depending on image data supplied from an external host computer and prints an image including a text, a figure, and the like corresponding to the image data. In the following description, a large format printer that can perform serial printing on a medium having a short edge width of A3 (297 mm) or greater among ink jet printers will be described as an example.

Figure 1:
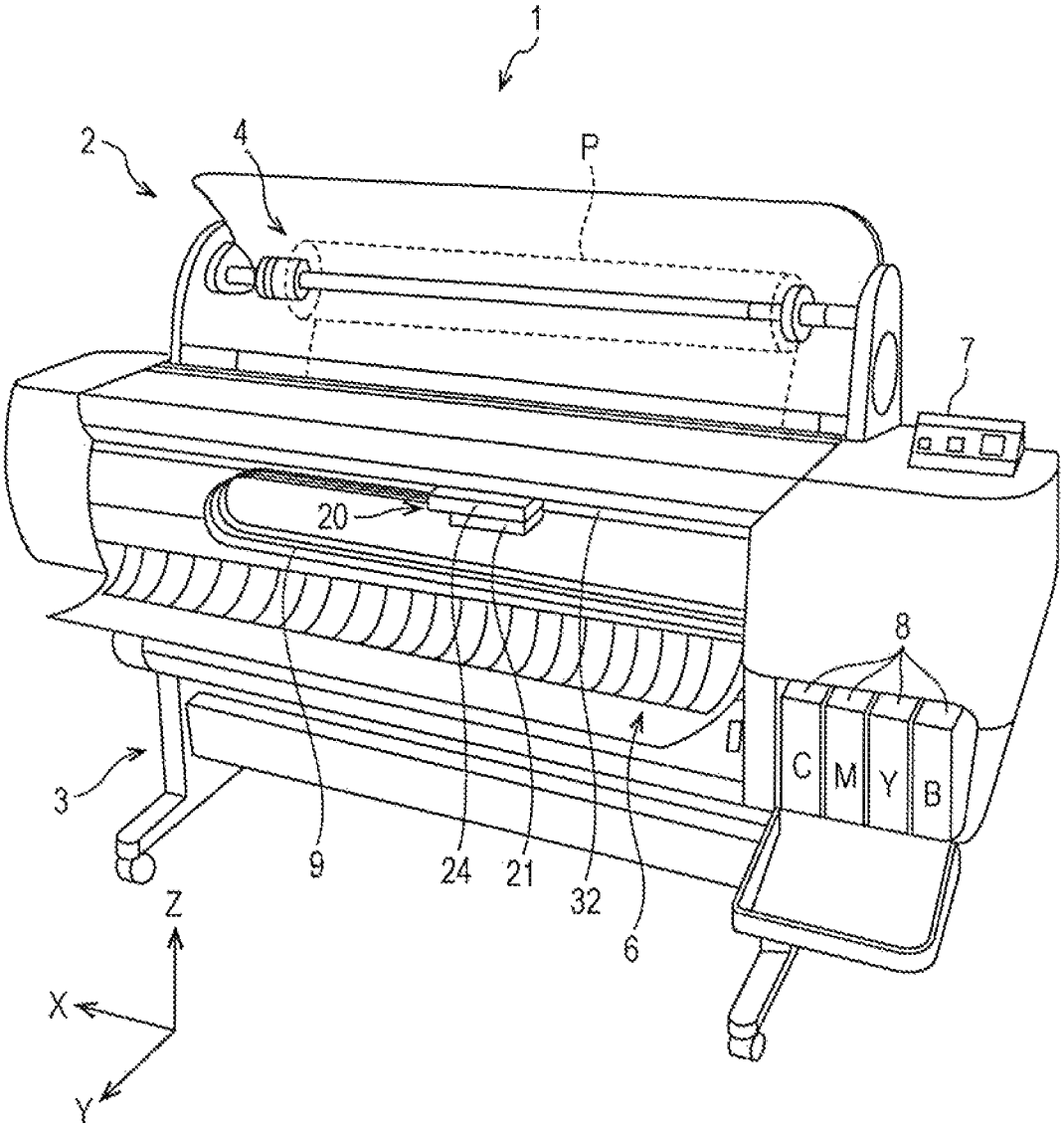
FIG. 1 is a schematic exterior view of a liquid ejecting apparatus.

FIG. 1 is a schematic exterior view of a liquid ejecting apparatus 1. The liquid ejecting apparatus 1 includes a main body 2 and a support stand 3 supporting the main body 2. The following description will be provided by denoting a movement direction of a carriage 24 by a main scan direction X, a transport direction of a printing medium P by a subscanning direction Y, and a vertical direction by Z in the liquid ejecting apparatus 1. In addition, in the following description, for the main scan direction X, the subscanning direction Y, and the vertical direction Z, the direction of an arrow illustrated in each drawing may be distinctively described as a positive direction, and a direction opposite to the arrow may be distinctively described as a negative direction. Specifically, in the main scan direction X, a direction in which the carriage 24 moves away from a home position described below is the positive direction, and the opposite direction is the negative direction. In addition, in the subscanning direction Y, a direction in which the printing medium P is transported downstream from upstream is the positive direction, and the opposite direction is the negative direction. In addition, in the vertical direction Z, a direction opposite to the direction of gravity is the positive direction, and the direction of gravity is the negative direction.

The main body 2 includes a supply unit 4 supplying the printing medium P such as a paper roll, a head unit 20 performing printing by ejecting ink drops to the printing medium P, a discharge unit 6 discharging the printing medium P subjected to printing by the head unit 20 to the outside of the main body 2, an operation unit 7 performing an operation such as execution and stopping of printing, and an ink retention unit 8 retaining ink to be ejected. In addition, while illustration is not provided, a USB port and a power supply port are included on the rear surface of the main body 2. That is, the liquid ejecting apparatus 1 is configured to be coupled to a computer or the like through the USB port.

The head unit 20 includes the carriage 24 and an ejecting head 21.

The ejecting head 21 includes a plurality of nozzles ejecting ink. The nozzles are mounted on the carriage 24 to face the printing medium P. The ejecting head 21 ejects ink drops from the plurality of nozzles. Details of the ejecting head 21 will be described below.

The carriage 24 is supported by a carriage guide shaft 32 and reciprocates in the main scan direction X. At this point, the printing medium P is transported in the subscanning direction Y. That is, the liquid ejecting apparatus 1 in the present embodiment performs serial printing by causing the carriage 24 on which the ejecting head 21 ejecting ink drops is mounted to reciprocate in the main scan direction X.

A plurality of ink cartridges are attached to the ink retention unit 8. Each ink cartridge is filled with ink of corresponding color. In FIG. 1, four ink cartridges corresponding to four colors of cyan (C), magenta (M), yellow (Y), and black (B) are illustrated. The ink cartridge is not limited to the present configuration. For example, five or more ink cartridges may be included in the ink retention unit 8. In addition, ink cartridges corresponding to colors such as gray, green, and violet may be included. The ink with which the ink cartridge is filled is supplied to the ejecting head 21 through an ink tube 9. The ink cartridge may be mounted on the carriage 24.

Figure 2:
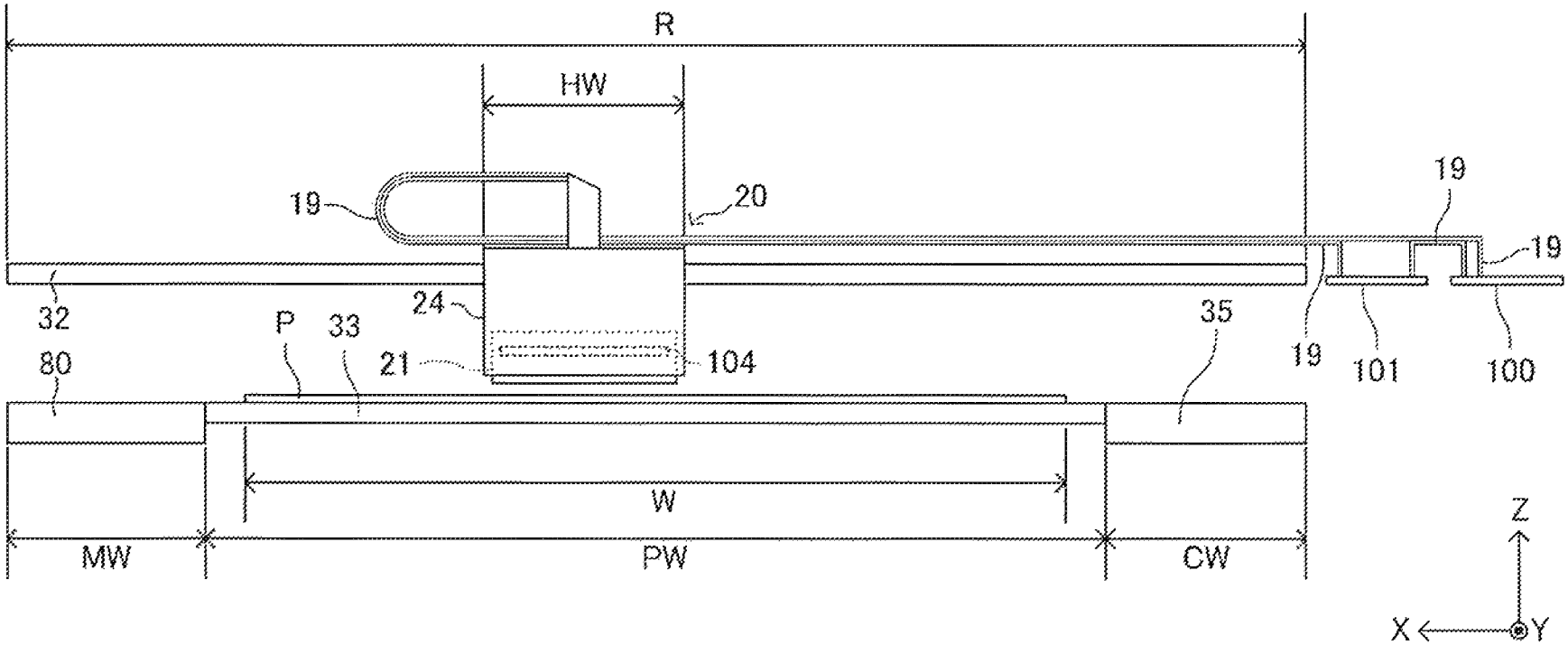
FIG. 2 is a diagram schematically illustrating an internal configuration when the liquid ejecting apparatus is seen in a negative direction of a subscanning direction.

FIG. 2 is a diagram schematically illustrating an internal configuration when the liquid ejecting apparatus 1 is seen in the negative direction of the subscanning direction Y. As illustrated in FIG. 2, the liquid ejecting apparatus 1 includes the head unit 20, the carriage guide shaft 32, a platen 33, a capping mechanism 35, and a maintenance mechanism 80.

The head unit 20 reciprocates within a range of a movable range R along the carriage guide shaft 32 based on control of a carriage moving mechanism not illustrated. The ejecting head 21 that is disposed such that an ink ejecting surface faces the printing medium P is mounted on the carriage 24. In addition, a head substrate 104 is mounted on the ejecting head 21.

A roller, not illustrated, transporting the printing medium P in the subscanning direction Y is disposed in the platen 33. In addition, the platen 33 holds the printing medium P when ink drops are ejected to the printing medium P.

The maximum width (hereinafter, referred to as the "maximum printing width") in which serial printing can be performed in the liquid ejecting apparatus 1 corresponds to a platen width PW that is the width of the platen 33 in the main scan direction X. The platen width PW is set to be greater than a standard dimension Ws of a medium width W that is the width of the printing medium P in the main scan direction X in order to stably hold and transport the printing medium P. In the first embodiment, the platen width PW corresponding to the maximum printing width satisfies $Ws<PW\leq Ws\times 1.15$ with respect to the standard dimension Ws.

For example, the liquid ejecting apparatus 1 having 24 inches of the standard dimension Ws of the medium width W is a printer corresponding to 24 inches of the maximum printing width and is specifically a printer having the maximum printing width greater than 24 inches and less than or equal to 27.6 inches. In addition, the liquid ejecting apparatus 1 having 36 inches of the standard dimension Ws of the medium width W is a printer corresponding to 36 inches of the maximum printing width and is specifically a printer having the maximum printing width greater than 36 inches and less than or equal to 41.4 inches. In addition, the liquid ejecting apparatus 1 having 44 inches of the standard dimension Ws of the medium width W is a printer corresponding to 44 inches of the maximum printing width and is specifically a printer having the maximum printing width greater than 44 inches and less than or equal to 50.6 inches. In addition, the liquid ejecting apparatus 1 having 64 inches of the standard dimension Ws of the medium width W is a printer corresponding to 64 inches of the maximum printing width and is specifically a printer having the maximum printing width greater than 64 inches and less than or equal to 73.6 inches.

In the movable range R of the head unit 20, the capping mechanism 35 for sealing the ink ejecting surface on which the plurality of nozzles are disposed in the ejecting head 21 is disposed at the home position that is the start point of reciprocation of the head unit 20. The home position is a position at which the head unit 20 waits when the liquid ejecting apparatus 1 does not execute printing.

In the movable range R of the head unit 20, the maintenance mechanism 80 is disposed on the opposite side of the platen 33 from the home position. The maintenance mechanism 80 performs a maintenance process such as a cleaning process of drawing viscous ink, air bubbles, and the like by a tube pump (not illustrated) and a wiping process of wiping a foreign object such as paper dust clinging to the ink ejecting surface of the ejecting head 21 by a wiper.

In addition, the liquid ejecting apparatus 1 includes a control substrate 100, a drive circuit substrate 101, and a plurality of cables 19. The control substrate 100 and the drive circuit substrate 101, the drive circuit substrate 101 and the head substrate 104, and the control substrate 100 and the head substrate 104 are electrically coupled to each other through one or the plurality of cables 19. The head substrate 104 is supplied with various signals propagating the cable 19. Ink is ejected from the plurality of nozzles formed on the ink ejecting surface of the ejecting head 21 based on various signals supplied to the head substrate 104. Details of the signals propagated through the plurality of cables 19 will be described below.

1.2 Electrical Configuration of Liquid Ejecting Apparatus

Figure 3:
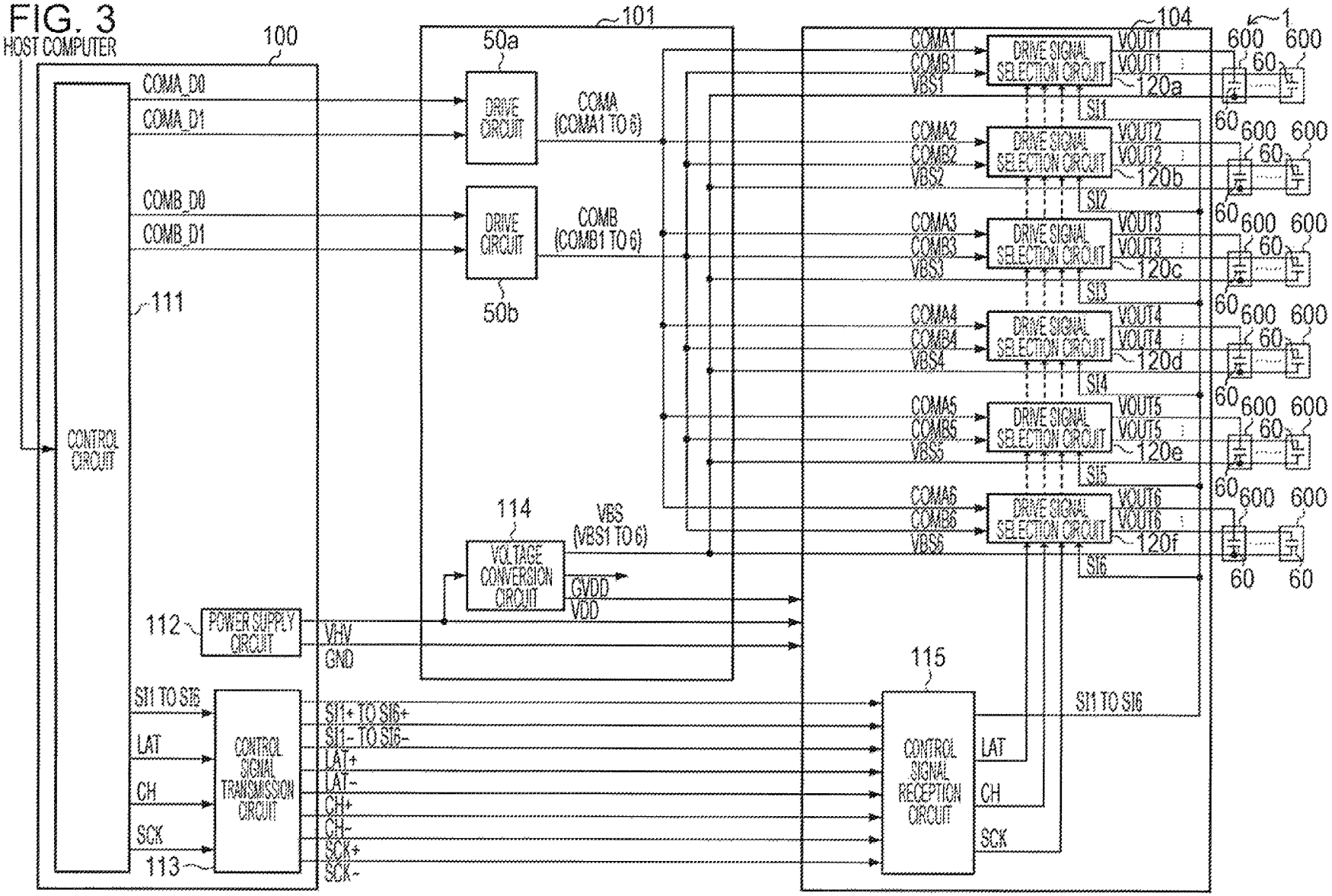
FIG. 3 is a block diagram illustrating an electrical configuration of the liquid ejecting apparatus.

FIG. 3 is a block diagram illustrating an electrical configuration of the liquid ejecting apparatus 1 according to the present embodiment. As described above, the liquid ejecting apparatus 1 includes the control substrate 100, the drive circuit substrate 101, and the head substrate 104. As illustrated in FIG. 3, a control circuit 111, a power supply circuit 112, and a control signal transmission circuit 113 are disposed (mounted) in the control substrate 100.

The control circuit 111 is implemented by a processor such as a microcomputer and generates various data and signals based on various signals such as the image data supplied from the host computer.

Specifically, based on various signals supplied from the host computer, the control circuit ill generates digital data as the sources of drive signals COMA and COMB for driving a piezoelectric element 60 included in a plurality of ejecting units 600. Specifically, the control circuit 111 generates 2-bit drive data COMA_D0 and COMA_D1 as the digital data as the source of the drive signal COMA. The drive data COMA_D0 and COMA_D1 propagate through the cable 19 illustrated in FIG. 2 and are supplied to a drive circuit 50*a* disposed in the drive circuit substrate 101. Similarly, the control circuit 111 generates 2-bit drive data COMB_D0 and COMB_D1 as the digital data as the source of the drive signal COMB. The drive data COMB_D0 and COMB_D1 propagate through the cable 19 illustrated in FIG. 2 and are supplied to a drive circuit 50*b* disposed in the drive circuit substrate 101.

In addition, based on various signals supplied from the host computer, the control circuit 111 generates six printing data signals SI1 to SI6, a latch signal LAT, a change signal CH, and a clock signal SCK as a plurality of kinds of control signals for controlling driving of the piezoelectric element 60 and supplies the control signals to the control signal transmission circuit 113.

In addition, the control circuit 111 performs a process of finding the current scan position of the carriage 24 illustrated in FIG. 3 and driving a carriage motor, not illustrated, based on the scan position of the carriage 24. Accordingly, reciprocation of the carriage 24 in the main scan direction X is controlled. In addition, the control circuit 111 performs a process of driving a transport motor not illustrated. Accordingly, movement of the printing medium P in the subscanning direction Y is controlled. Furthermore, the control circuit 111 causes the maintenance mechanism 80 illustrated in FIG. 3 to execute the maintenance process such as the cleaning process and the wiping process.

Besides the above processes, the control circuit 111 may generate the drive data COMA_D0 and COMA_D1 and the drive data COMB_D0 and COMB_D1 in which the waveforms of the drive signals COMA and COMB are corrected depending on a temperature signal indicating the temperature of the ejecting head 21. In addition, the control circuit 111 may stop supplying the drive data COMA_D0 and COMA_D1 and the drive data COMB_D0 and COMB_D1 to the drive circuits 50*a* and 50*b* depending on a malfunction signal indicating a malfunction of the ejecting head 21.

The control signal transmission circuit 113 converts the six printing data signals SI1 to SI6 supplied from the control circuit 111 into differential signals [SI1+, SI1−] to [SI6+, SI6−], respectively. In addition, the control signal transmission circuit 113 converts the latch signal LAT, the change signal CH, and the clock signal SCK supplied from the control circuit 111 into differential signals [LAT+, LAT−], [CH+, CH−], and [SCK+, SCK−], respectively. The differential signals [SI1+, SI1−] to [SI6+, SI6−], [LAT+, LAT−], [CH+, CH−], and [SCK+, SCK−] are transmitted to a control signal reception circuit 115 disposed in the head substrate 104 by propagating through the cable 19. For example, the control signal transmission circuit 113 generates the differential signal of a low voltage differential signaling (LVDS) transfer type. The differential signal of the LVDS transfer type has an amplitude of approximately 350 mV. Thus, high speed data transfer can be implemented. The control signal transmission circuit 113 may generate the differential signal of various high speed transfer types such as low voltage positive emitter coupled logic (LVPECL) and current mode logic (CML) other than LVDS.

For example, the power supply circuit 112 generates a high voltage signal VHV of DC 42 V and a ground voltage signal GND having a ground potential. The high voltage signal VHV propagates through the cable 19 and is supplied to the drive circuits 50*a* and 50*b* disposed in the drive circuit substrate 101 and drive signal selection circuits 120*a* to 120*f* disposed in the head substrate 104. In-addition, the ground voltage signal GND propagates through the cable 19 and is supplied to each circuit disposed in the drive circuit substrate 101 and each circuit disposed in the head substrate 104.

The two drive circuits 50*a* and 50*b* and a voltage conversion circuit 114 are disposed (mounted) in the drive circuit substrate 101.

The voltage conversion circuit 114 is supplied with the high voltage signal VHV. For example, the voltage conversion circuit 114 converts the high voltage signal VHV into a low voltage signal VDD of DC 3.3 V. In addition, for example, the voltage conversion circuit 114 converts the high voltage signal VHV into a power supply voltage signal GVDD of DC 7.5 V and supplies the power supply voltage signal GVDD to the drive circuits 50*a* and 50*b*. In addition, for example, the voltage conversion circuit 114 converts the high voltage signal VHV into a reference voltage signal VBS of DC 6 V. The reference voltage signal VBS may also be converted from the power supply voltage signal GVDD.

The drive circuit 50*a* generates the drive signal COMA based on the 2-bit drive data COMA_D0 and COMA_D1 supplied from the control circuit 111. Similarly, the drive circuit 50*b* generates the drive signal COMB based on the 2-bit drive data COMB_D0 and COMB_D1 supplied from the control circuit 111. The only difference between the drive circuits 50*a* and 50*b* is the supplied drive data and the output drive signal. Circuit configurations may be the same. Accordingly, in the following description, the drive circuits 50*a* and 50*b* may be referred to as a drive circuit 50 when not necessary to distinguish the drive circuits 50*a* and 50*b*. Details of the drive circuits 50*a* and 50*b* will be described below.

The drive signal COMA generated by the drive circuit 50*a* is divided into six drive signals COMA1 to COMA6 in the drive circuit substrate 101. Similarly, the drive signal COMB generated by the drive circuit 50*b* is divided into six drive signals COMB1 to CCMB6 in the drive circuit substrate 101. In addition, the reference voltage signal VBS generated by the voltage conversion circuit 114 is divided into six reference voltage signals VBS1 to VBS6 in the drive circuit, substrate 101. The drive signals COMA1 to COMA6 output from the drive circuit substrate 101 are signals having the same waveform. The drive signals COMB1 to COMB6 are signals having the same waveform. The reference voltage signals VBS1 to VBS6 are signals having the same waveform. Accordingly, in the following description, the drive signals COMA1 to COMA6 may be referred to as the drive signal COMA when not necessary to distinguish the drive signals COMA1 to COMA6. Similarly, the drive signals COMB1 to COMB6 may be referred to as the drive signal COMB when not necessary to distinguish the drive signals COMB1 to COMB6. Similarly, the reference voltage signals VBS1 to VBS6 may be referred to as the reference voltage signal VBS when not necessary to distinguish the reference voltage signals VBS1 to VBS6.

The drive signals COMA1 to COMA6 and COMB1 to COMB6 and the reference voltage signals VBS1 to VBS6 are supplied to the head substrate 104 by propagating through one or the plurality of cables 19.

The six drive signal selection circuits 120*a* to 120*f* and the control signal reception circuit 115 are disposed (mounted) in the head substrate 104.

The control signal reception circuit 115 receives the differential signals [SI1+, SI1−] to [SI6+, SI6−], [LAT+, LAT−], [CH+, CH−], and [SCK+, SCK−] transmitted from the control signal transmission circuit 113 and converts the differential signals into the single-ended printing data signals SI1 to SI6, the latch signal LAT, the change signal CH, and the clock signal SCK by differentially amplifying each received differential signal.

The printing data signals SI1 to SI6 are supplied to the drive signal selection circuits 120*a* to 120*f*, respectively. In addition, the latch signal LAT, the change signal CH, and the clock signal SCK are supplied to the drive signal selection circuits 120*a* to 120*f* in common.

The drive signal selection circuits 120*a* to 120*f* generate drive signals VOUT1 to VOUT6 by selecting or not selecting any of the drive signals COMA1 to COMA6 and COMB1 to COMB6 based on the printing data signals SI1 to SI6, the clock signal SCK, the latch signal LAT, and the change signal CH. The drive signal selection circuits 120*a* to 120*f* supply the drive signals VOUT1 to VOUT6 to any of the plurality of ejecting units 600.

Specifically, the drive signal selection circuit 120*a* outputs the drive signal VOUT1 by selecting or not selecting the drive signals COMA1 and COMB1. The drive signal VOUT1 is supplied to one end of the piezoelectric element 60 included in each ejecting unit 600 disposed in correspondence. In addition, the reference voltage signal VBS1 is supplied to another end of the piezoelectric element 60.

In addition, the drive signal selection circuit 120*b* selects or does not select the drive signals COMA2 and COMB2 and outputs the drive signal VOUT2. The drive signal VOUT2 is supplied to one end of the piezoelectric element 60 included in each ejecting unit 600 disposed in correspondence. In addition, the reference voltage signal VBS2 is supplied to the other end of the piezoelectric element 60.

In addition, the drive signal selection circuit 120*c* selects or does not select the drive signals COMA3 and COMB3 and outputs the drive signal VOUT3. The drive signal VOUT3 is supplied to one end of the piezoelectric element 60 included in each ejecting unit 600 disposed in correspondence. In addition, the reference voltage signal VBS3 is supplied to the other end of the piezoelectric element 60.

In addition, the drive signal selection circuit 120*d* selects or does not select the drive signals COMA4 and COMB4 and outputs the drive signal VOUT4. The drive signal VOUT4 is supplied to one end of the piezoelectric element 60 included in each ejecting unit 600 disposed in correspondence. In addition, the reference voltage signal VBS4 is supplied to the other end of the piezoelectric element 60.

In addition, the drive signal selection circuit 120*e* selects or does not select the drive signals COMA5 and COMB5 and outputs the drive signal VOUT5. The drive signal VOUT5 is supplied to one end of the piezoelectric element 60 included in each ejecting unit 600 disposed in correspondence. In addition, the reference voltage signal VBS5 is supplied to the other end of the piezoelectric element 60.

In addition, the drive signal selection circuit 120*f* selects or does not select the drive signals COMA6 and COMB6 and outputs the drive signal VOUT6. The drive signal VOUT6 is supplied to one end of the piezoelectric element 60 included in each ejecting unit 600 disposed in correspondence. In addition, the reference voltage signal VBS6 is supplied to the other end of the piezoelectric element 60.

As described above, the drive signals COMA1 to COMA6 and COMB1 to COMB6 are signals having the same waveform. Accordingly, the drive signals VOUT1 to VOUT6 generated by selecting or not selecting the drive signals COMA1 to COMA6 and COMB1 to COMB6 are ideal signals having the same waveform. Accordingly, in the following description, the drive signals VOUT1 to VOUT6 may be referred to as a drive signal VOUT when not necessary to distinguish the drive signals VOUT1 to VOUT6.

The drive signal selection circuits 120*a* to 120*f* may have the same circuit configuration. Accordingly, the drive signal selection circuits 120*a* to 120*f* may be referred to as a drive signal selection circuit 120 when not necessary to distinguish the drive signal selection circuits 120*a* to 120*f*. In addition, details of the drive signal selection circuit 120 will be described below.

Each piezoelectric element 60 is displaced depending on a difference in potential between the drive signals VOUT1 to VOUT6 supplied to one end and the reference voltage signals VBS1 to VBS6 supplied to the other end. Ink corresponding to the displacement is ejected from the ejecting unit 600.

In the liquid ejecting apparatus 1 described thus far, the drive circuit 50*a* is one example of a first drive circuit, and the drive circuit 50*b* is one example of a second drive circuit. In addition, in the drive signal COMA output by the drive circuit 50*a*, the drive signal COMA1 is one example of a first drive signal. The drive signal COMA2 is one example of a fifth drive signal. The drive signal COMA3 is one example of a third drive signal. In addition, in the drive signal COMB output by the drive circuit 50*b*, the drive signal COMB1 is one example of a fourth drive signal. The drive signal COMB2 is one example of a second drive signal. The drive signal COMB3 is one example of a sixth drive signal. In addition, in the reference voltage signal VBS, the reference voltage signal VBS1 is one example of a first reference voltage signal, and the reference voltage signal VBS2 is one example of a second reference voltage signal.

1.3 Configuration of Ejecting Unit

Figure 4:
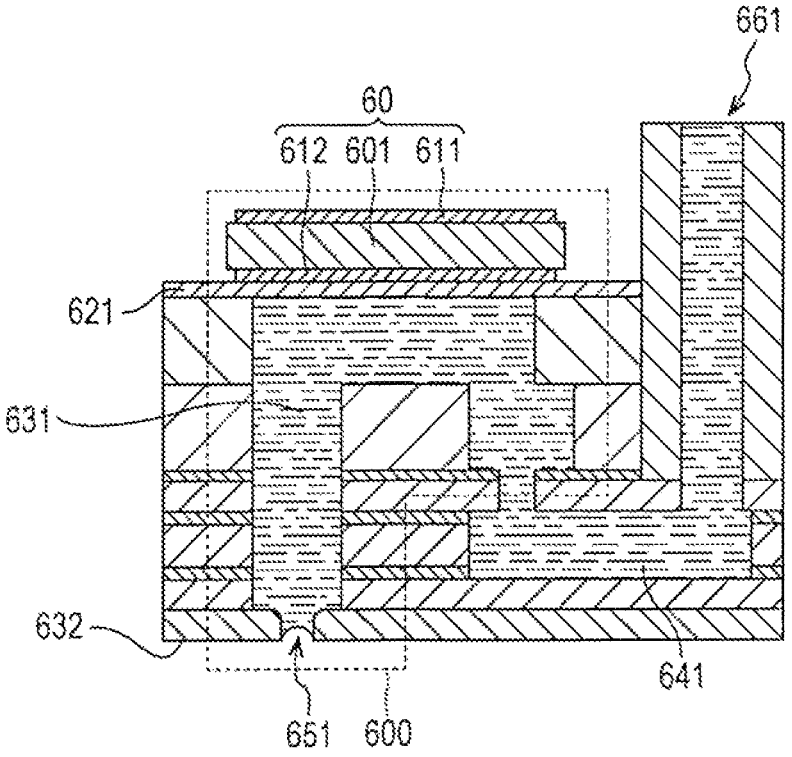
FIG. 4 is a diagram illustrating a schematic configuration corresponding to an ejecting unit.

Next, a configuration of the ejecting unit 600 will be described. FIG. 4 is a diagram illustrating a schematic configuration corresponding to one ejecting unit 600. As illustrated in FIG. 4, the ejecting unit 600 and a reservoir 641 are included.

The reservoir 641 is disposed for each color of ink. Ink is introduced into the reservoir 641 from a supply port 661. Ink is supplied to the supply port 661 from the ink retention unit 8 through the ink tube 9.

The ejecting unit 600 includes the piezoelectric element 60, a vibration plate 621, a cavity 631 functioning as a pressure chamber, and a nozzle 651. The vibration plate 621 functions as a diaphragm that is displaced (flexurally vibrates) by the piezoelectric element 60 disposed on its upper surface in FIG. 4 and increases/decreases the internal capacity of the cavity 631 filled with ink. The nozzle 651 is an open hole unit that is disposed in a nozzle plate 632 and communicates with the cavity 631. The cavity 631 is filled with ink in its inside, and the internal capacity of the cavity 631 is changed by displacement of the piezoelectric element 60. The nozzle 651 communicates with the cavity 631 and ejects ink inside the cavity 631 as ink drops in response to a change in the internal capacity of the cavity 631. That is, the ejecting head 21 includes the plurality of ejecting units 600 ejecting ink by driving the piezoelectric element 60.

The piezoelectric element 60 illustrated in FIG. 4 has a structure in which a piezoelectric body 601 is interposed between a pair of electrodes 611 and 612. In the piezoelectric body 601 of this structure, a center part bends upward and downward along with the electrodes 611 and 612 and the vibration plate 621 with respect to both end parts in FIG. 4 in response to voltages applied to the electrodes 611 and 612. Specifically, the piezoelectric element 60 is configured to bend upward when the voltage of the drive signal VOUT is increased and bend downward when the voltage of the drive signal VOUT is decreased. In this configuration, when the piezoelectric element 60 bends upward, the internal capacity of the cavity 631 is increased. Thus, ink is drawn from the reservoir 641. When the piezoelectric element 60 bends downward, the internal capacity of the cavity 631 is decreased. Thus, ink is ejected from the nozzle 651 depending on the degree of decrease.

The piezoelectric element 60 is not limited to the illustrated structure and may be of a type that can eject a liquid such as ink by deforming the piezoelectric element 60. In addition, the piezoelectric element 60 may be configured to use not only the flexural vibration but also so-called longitudinal vibration.

Figure 5:
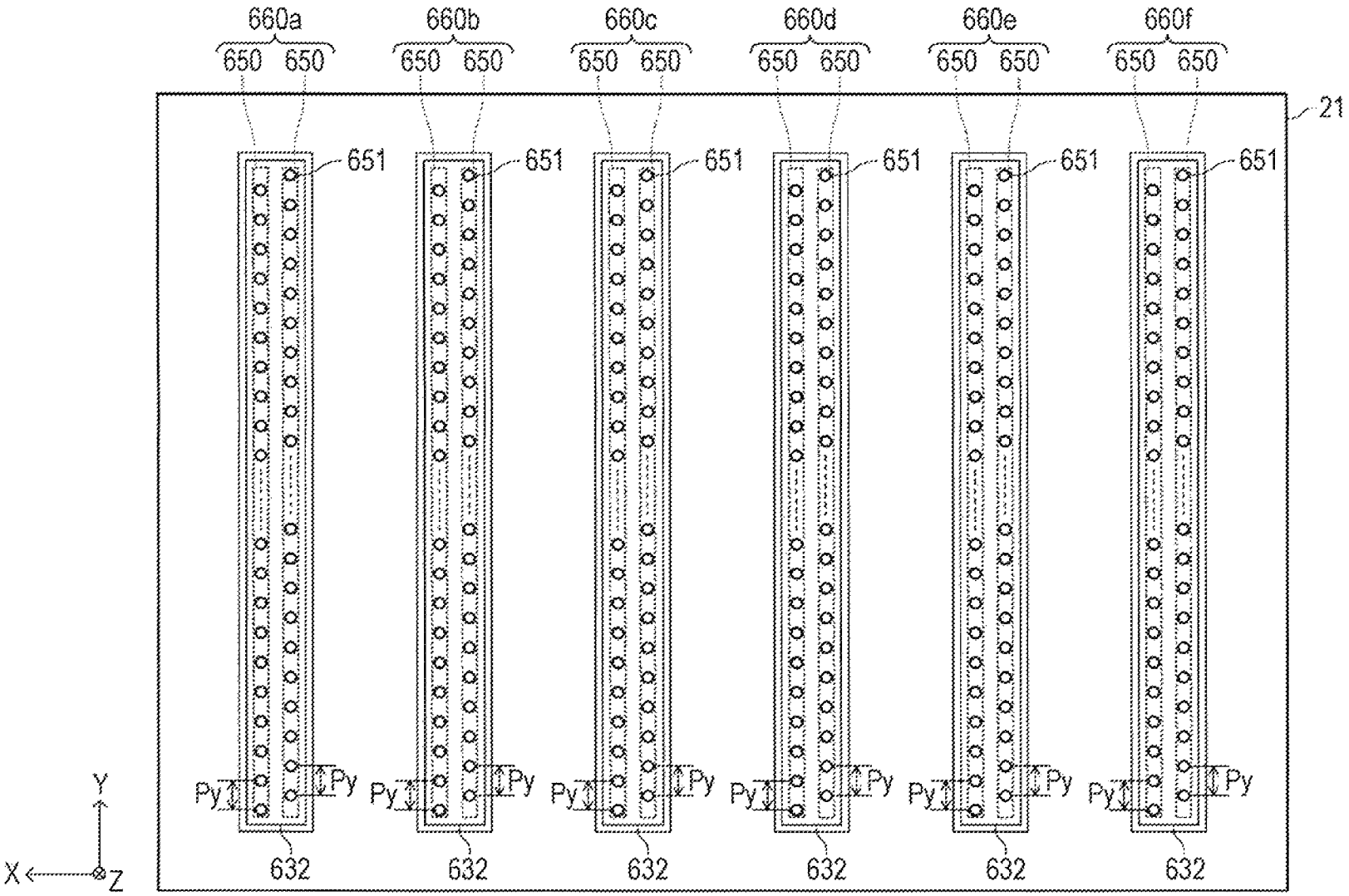
FIG. 5 is a diagram illustrating an ink ejecting surface on which nozzles included in a plurality of ejecting units are disposed in an ejecting head.

The plurality of ejecting units 600 configured as described above are disposed in the ejecting head 21. FIG. 5 is a diagram illustrating the ink ejecting surface on which the nozzles 651 included in the plurality or ejecting units 600 are disposed in the ejecting head 21.

As illustrated in FIG. 5, six nozzle plates 632 are linearly disposed in the main scan direction X on the ink ejecting surface of the ejecting head 21. Two nozzle arrays 650 lined up in the subscanning direction Y are formed in each nozzle plate 632. In each nozzle array 650, the nozzles 651 are linearly disposed at a density of 300 or more per 1 inch at a predetermined pitch Py in the subscanning direction Y. In the two nozzle arrays 650 disposed in each nozzle plate 632, total 600 or more nozzles 651 are formed in a relationship such that each nozzle 651 is shifted by half of the pitch Py in the subscanning direction Y. That is, total 3,600 or more nozzles are formed in the ejecting head 21. In the following description, the two nozzle arrays 650 disposed in each nozzle plate 632 may be referred to as a nozzle group 660. The nozzle groups 660 formed in the six nozzle plates 632 linearly disposed in the main scan direction X may be referred to as a first nozzle group 660*a* to a sixth nozzle group 660*f*.

The drive signals VOUT1 to VOUT6 described above are supplied in correspondence to the first nozzle group 660*a* to the sixth nozzle group 660*f*, respectively. Specifically, the drive signal VOUT1 is supplied to one end of the piezoelectric element 60 included in the ejecting unit 600 disposed in correspondence with the nozzle 651 included in the first nozzle group 660*a*. The reference voltage signal VBS1 is supplied to the other end of each piezoelectric element 60 disposed in the first nozzle group 660*a*. In addition, the drive signal VOUT2 is supplied to one end of the piezoelectric element 60 included in the ejecting unit 600 disposed in correspondence with the nozzle 651 included in the second nozzle group 660*b*. The reference voltage signal VBS2 is supplied to the other end of each piezoelectric element 60 disposed in the second nozzle group 660*b*. In addition., the drive signal VOUT3 is supplied to one end of the piezoelectric element 60 included in the ejecting unit 600 disposed in correspondence with the nozzle 651 included in the third nozzle group 660*c*. The reference voltage signal VBS3 is supplied to the other end of each piezoelectric element 60 disposed in the third nozzle group 660*c*. In addition, the drive signal VOUT4 is supplied to one end of the piezoelectric element 60 included in the ejecting unit 600 disposed in correspondence with the nozzle 651 included in the fourth nozzle group 660*d*. The reference voltage signal VBS4 is supplied to the other end of each piezoelectric element 60 disposed in the fourth nozzle group 660*d*. In addition, the drive signal VOUT5 is supplied to one end of the piezoelectric element 60 included in the ejecting unit 600 disposed in correspondence with the nozzle 651 included in the fifth nozzle group 660*e*. The reference voltage signal VBS5 is supplied to the other end of each piezoelectric element 60 disposed in the fifth nozzle group 660*e*. In addition, the drive signal VOUT6 is supplied to one end of the piezoelectric element 60 included in the ejecting unit 600 disposed in correspondence with the nozzle 651 included in the sixth nozzle group 660*f*. The reference voltage signal VBS6 is supplied to the other end of each piezoelectric element 60 disposed in the sixth nozzle group 660*f*.

In the first embodiment, the ejecting unit 600 corresponding to the nozzle 651 disposed in the first nozzle group 660*a* among the plurality of nozzle groups 660 disposed in the ejecting head 21 as described above is one example of a first ejecting unit. The piezoelectric element 60 included in the ejecting unit 600 is one example of a first piezoelectric element. Similarly, the ejecting unit 600 corresponding to the nozzle 651 disposed in the second nozzle group 660*b* is one example of a second ejecting unit. The piezoelectric element 60 included in the ejecting unit 600 is one example of a second piezoelectric element. Similarly, the ejecting unit 600 corresponding to the nozzle 651 disposed in the third nozzle group 660*c* is one example of a third ejecting unit. The piezoelectric element 60 included in the ejecting unit 600 is one example of a third piezoelectric element.

1.4 Configuration of Drive Signal

Methods for supplying the drive signal VOUT to the piezoelectric element 60 and forming a dot on the printing medium P include not only a method of forming one dot by ejecting an ink drop once but also a method (second method) of enabling two or more ejections of ink drops in a unit period and forming one dot by causing one or more ink drops ejected in the unit period to hit the printing medium P and combining the one or more hit ink drops, and a method (third method) of forming two or more dots without combining two or more ink drops. In the first embodiment, four shades of "large dot", "medium dot", "small dot", and "no recording (no dot)" are represented by ejecting ink at most twice for one dot using the second method.

In the first embodiment, four shades of "large dot", "medium dot", "small dot", and "no recording (no dot)" are represented using two kinds of drive signals COMA and COMB. Specifically, the drive signals COMA and COMB are set to have a first half pattern and a second half pattern in their one cycle. The drive signals COMA and COMB are selected or not selected in the first half and the second half of one cycle depending on the shade to be represented, and the drive signal VOUT is generated.

Figure 6:
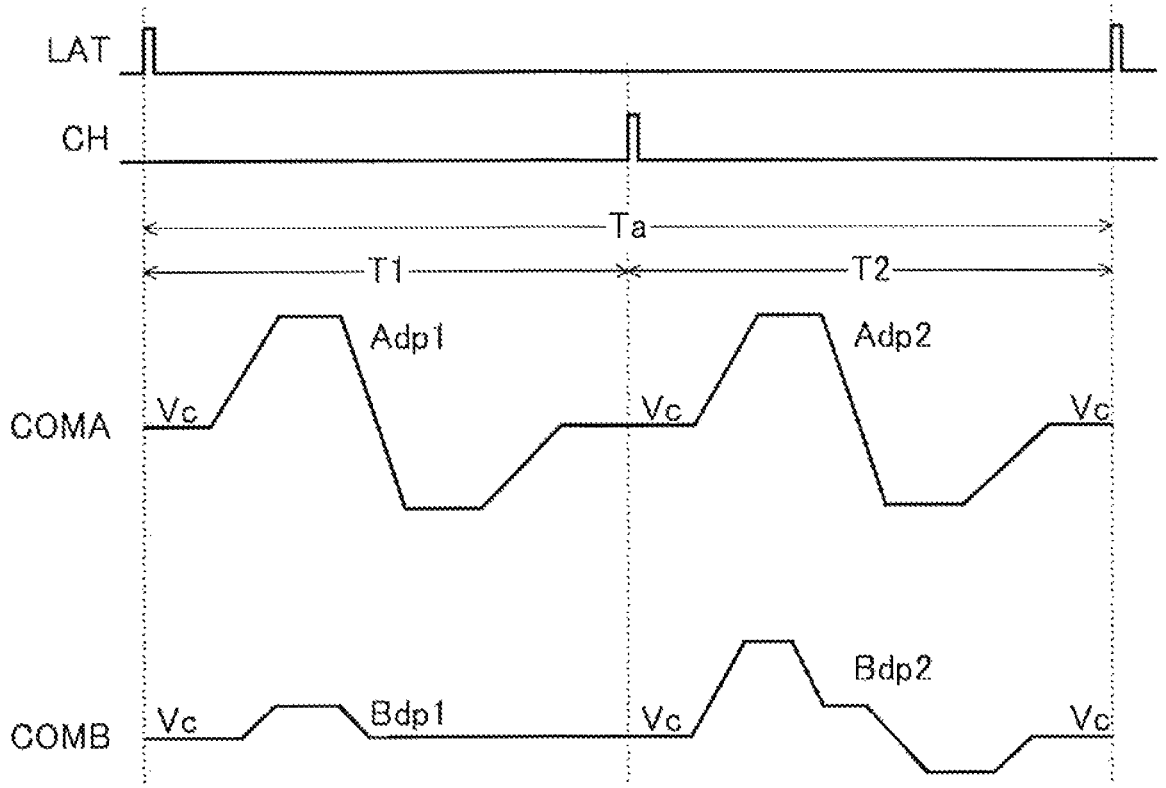
FIG. 6 is a diagram illustrating one example of drive signals.

FIG. 6 is a diagram illustrating one example of the drive signals COMA and COMB. As illustrated in FIG. 6, the drive signal COMA has a waveform in which a trapezoidal waveform Adp1 arranged in a period T1 from a rise of the latch signal LAT until a rise of the change signal CH and a trapezoidal waveform Adp2 arranged in a period T2 from the rise of the change signal CH until a rise of the latch signal LAT are consecutive. A period including the period T1 and the period T2 is a cycle Ta. For each cycle Ta, a new dot is formed on the printing medium P. In the first embodiment, the trapezoidal waveforms Adp1 and Adp2 have almost the same waveform. When each of the trapezoidal waveforms Adp1 and Adp2 is supplied to one end of the piezoelectric element 60, a predetermined amount of ink, specifically, approximately a medium amount, is ejected from the nozzle 651 corresponding to the piezoelectric element 60.

The drive signal COMB has a waveform in which a trapezoidal waveform Bdp1 arranged in the period T1 and a trapezoidal waveform Bdp2 arranged in the period T2 are consecutive. The trapezoidal waveforms Bdp1 and Bdp2 are waveforms different from each other. Of the trapezoidal waveforms Bdp1 and Bdp2, the trapezoidal waveform Bdp1 is a waveform for preventing an increase in the viscosity of ink by providing micro-vibration to the ink around the open hole unit of the nozzle 651. When the trapezoidal waveform Bdp1 is supplied to one end of the piezoelectric element 60, ink drops are not ejected from the nozzle 651 corresponding to the piezoelectric element 60. In addition, the trapezoidal waveform Bdp2 is a waveform different from the trapezoidal waveforms Adp1 and Adp2 and the trapezoidal waveform Bdp1. When the trapezoidal waveform Bdp2 is supplied to one end of the piezoelectric element 60, a smaller amount of ink than the predetermined amount is ejected from the nozzle 651 corresponding to the piezoelectric element 60.

Any of the voltages at the start timings and the end timings of the trapezoidal waveforms Adp1, Adp2, Bdp1, and Bdp2 is equal to a voltage Vc. That is, each of the trapezoidal waveforms Adp1, Adp2, Bdp1, and Bdp2 is a waveform that starts at the voltage Vc and ends at the voltage Vc.

The drive signal COMA and the drive signal COMB have different signal waveforms. The maximum voltage of the drive signal COMA is higher than the maximum voltage of the drive signal COMB.

Figure 7:
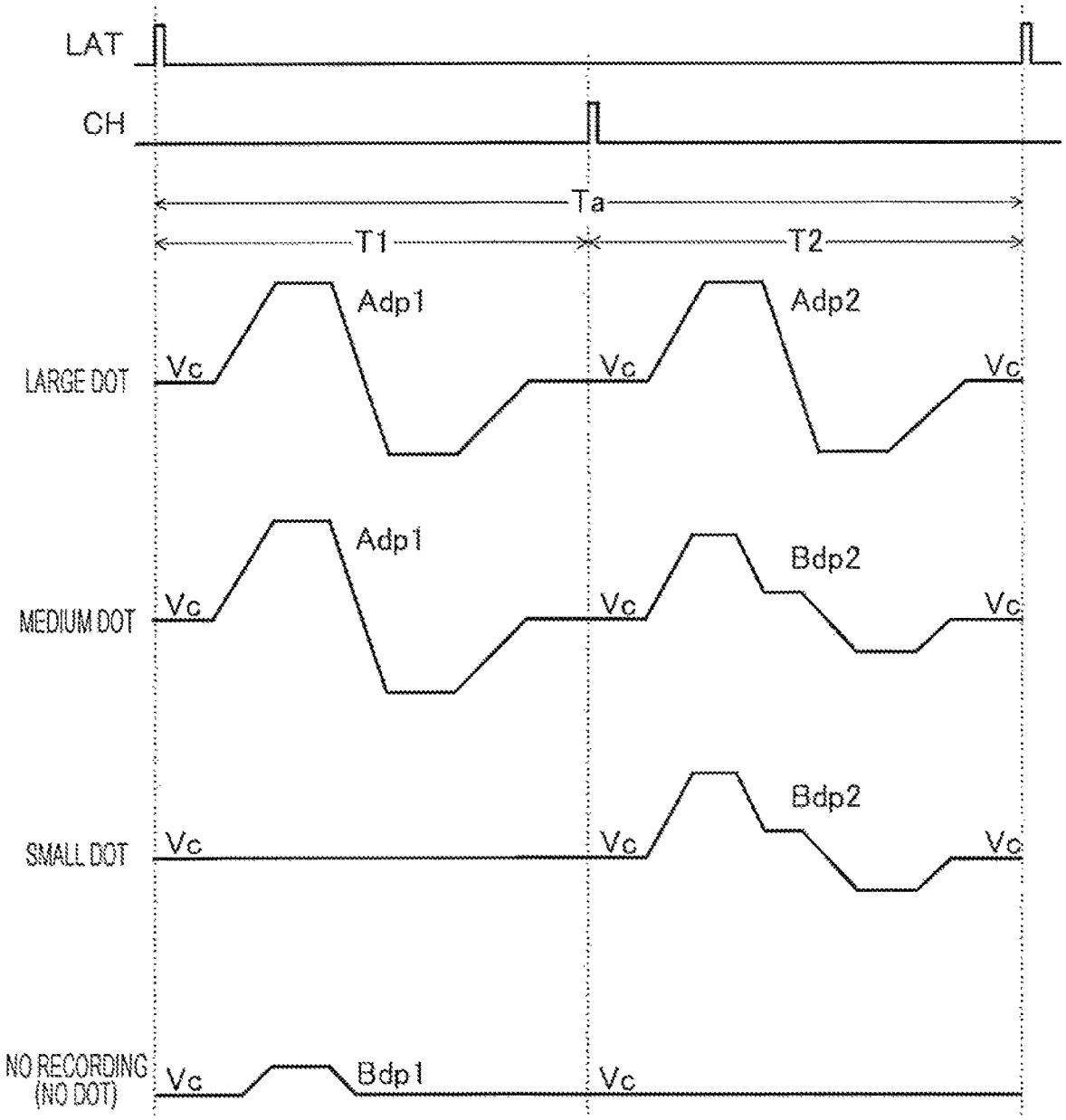
FIG. 7 is a diagram illustrating one example of a drive signal.

FIG. 7 is a diagram illustrating one example of the drive signal VOUT corresponding to each of "large dot", "medium dot", "small dot", and "no recording".

As illustrated in FIG. 7, the drive signal VOUT corresponding to "large dot" has a waveform in which the trapezoidal waveform Adp1 of the drive signal COMA in the period T1 and the trapezoidal waveform Adp2 of the drive signal COMA in the period T2 are consecutive. When the drive signal VOUT is supplied to one end of the piezoelectric element 60, approximately a medium amount of ink is ejected in two ejections from the nozzle 651 corresponding to the piezoelectric element 60 in the cycle Ta. Thus, each ink hits the printing medium P and combines to form a large dot.

The drive signal VOUT corresponding to "medium dot" has a waveform in which the trapezoidal waveform Adp1 of the drive signal COMA in the period T1 and the trapezoidal waveform Bdp2 of the drive signal COMB in the period T2 are consecutive. When the drive signal VOUT is supplied to one end of the piezoelectric element 60, approximately a medium amount or approximately a small amount of ink is ejected in two ejections from the nozzle 651 corresponding to the piezoelectric element 60 in the cycle Ta. Thus, each ink hits the printing medium P and combines to form a medium dot.

The drive signal VOUT corresponding to "small dot" has a waveform in which the immediately previous voltage Vc held by the capacitance of the piezoelectric element 60 in the period T1 and the trapezoidal waveform Bdp2 of the drive signal COMB in the period T2 are consecutive. When the drive signal VOUT is supplied to one end of the piezoelectric element 60, approximately a small amount of ink is ejected from the nozzle 651 corresponding to the piezoelectric element 60 in only the period T2 in the cycle Ta. Thus, the ink hits the printing medium P and forms a small dot.

The drive signal VOUT corresponding to "no recording" has a waveform in which the trapezoidal waveform Bdp1 of the drive signal COMB in the period T1 and the immediately previous voltage Vc held by the capacitance of the piezoelectric element 60 in the period T2 are consecutive. When the drive signal VOUT is supplied to one end of the piezoelectric element 60, only micro-vibration is provided to the nozzle 651 corresponding to the piezoelectric element 60 in the period T2, and ink is not ejected in the cycle Ta. Thus, ink does not hit the printing medium P, and a dot is not formed.

The drive signals COMA and COMB and the drive signal VOUT illustrated in FIG. 6 and FIG. 7 are merely one example. A combination of various waveforms prepared in advance is used depending on the moving speed of the head unit 20, properties of the printing medium P, and the like.

1.5 Configuration of Drive Signal Selection Circuit

A configuration of the drive signal selection circuit 120 generating the drive signal VOUT by selecting or not selecting the drive signals COMA and COMB will be described. In the following description, the printing data signals SI1 to SI6 supplied to the drive signal selection circuit 120 will be referred to as a printing data signal SI.

Figure 8:
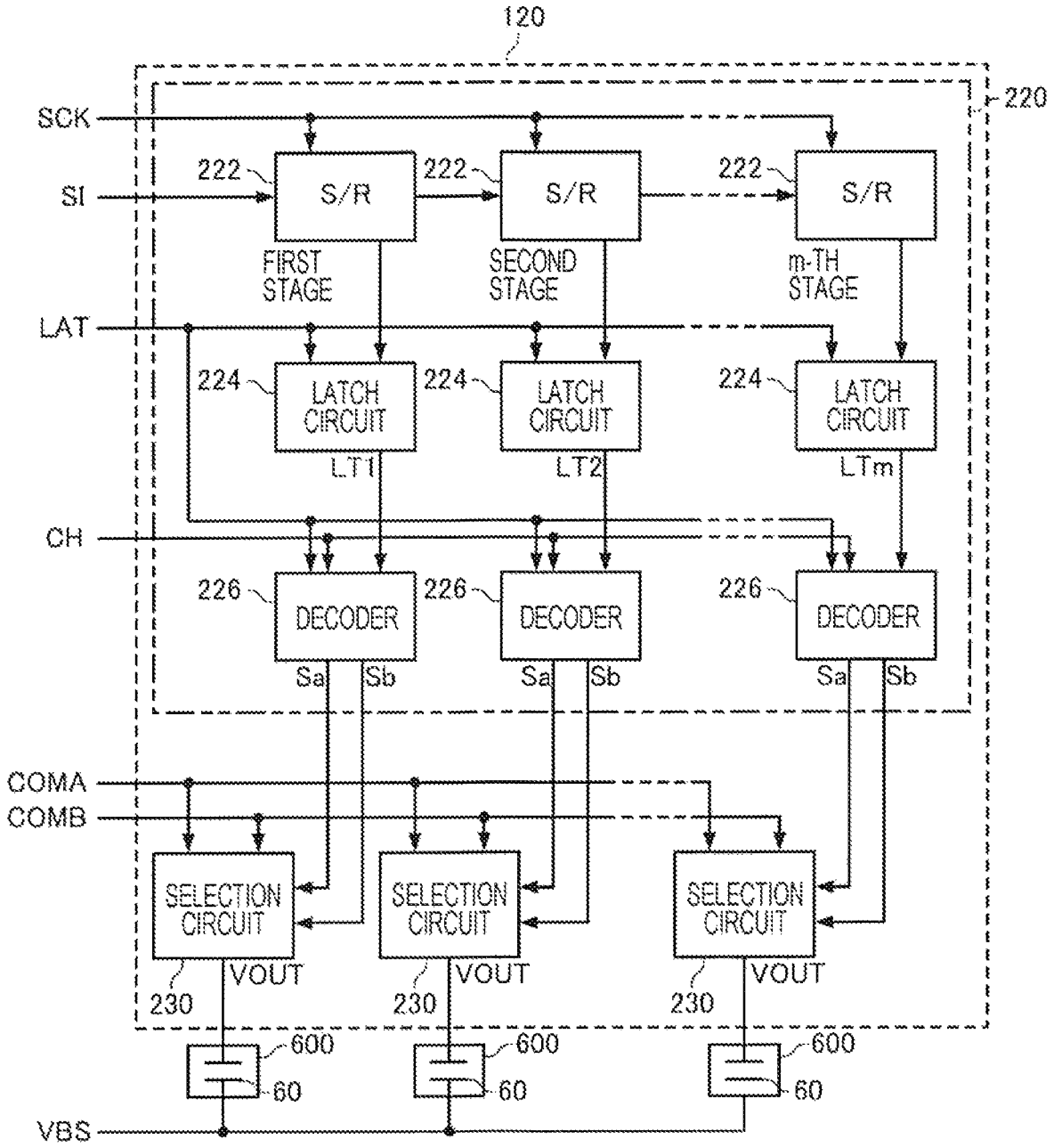
FIG. 8 is a diagram illustrating a configuration of a drive signal selection circuit.

FIG. 8 is a diagram illustrating a configuration of the drive signal selection circuit 120. As illustrated in FIG. 8, the drive signal selection circuit 120 includes a selection control circuit 220 and a plurality of selection circuits 230.

The selection control circuit 220 is supplied with the clock signal SCK, the printing data signal SI, the latch signal LAT, and the change signal CH. In addition, a set of a shift register (S/R) 222, a latch circuit 224, and a decoder 226 is disposed in the selection control circuit 220 in correspondence with each ejecting unit 600. That is, one drive signal selection circuit 120 includes the same number of sets of the shift register 222, the latch circuit 224, and the decoder 226 as a total number m of nozzles 651 or piezoelectric elements 60 included in the nozzle group 660.

The printing data signal SI is a total 2 m-bit signal including 2-bit printing data [SIH, SIL] for selecting any of "large dot", "medium dot", "small dot", and "no recording" for each of m ejecting units 600. The printing data signal SI is a signal in synchronization with the clock signal SCK. The printing data signal SI is temporarily held in the shift register 222 in correspondence with the nozzle 651 for each 2-bit printing data [SIH, SIL] included in the printing data signal SI. Specifically, m stages of shift registers 222 corresponding to the piezoelectric elements 60 are coupled to each other in cascade, and the serially supplied printing data signal SI is sequentially transferred to the subsequent stage in accordance with the clock signal SCK. In FIG. 8, a first stage, a second stage, . . . , an m-th stage are written in order from upstream of supply of the printing data signal SI in order to distinguish the shift registers 222.

Each of m latch circuits 224 latches the 2-bit printing data [SIH, SIL] held in each of m shift registers 222 at a rise of the latch signal LAT.

Each of m decoders 226 decodes the 2-bit printing data [SIH, SIL] latched by each of m latch circuits 224 and outputs selection signals Sa and Sb to the selection circuit 230 for each of the periods T1 and T2 defined by the latch signal LAT and the change signal CH.

Figures 9, 10:
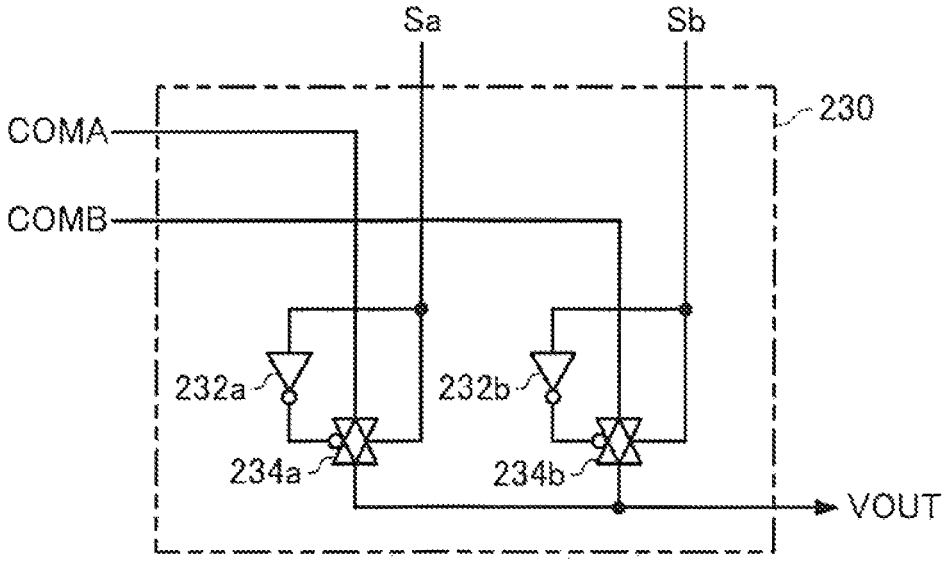
FIG. 9 is a diagram illustrating a decoding content in a decoder.
FIG. 10 is a diagram illustrating a configuration of a selection circuit.

FIG. 9 is a diagram illustrating a decoding content in the decoder 226. For example, it is meant that when the latched 2-bit printing data [SIH, SIL] is [1, 0], the decoder 226 respectively outputs the logical levels of the selection signals Sa and Sb at H and L levels in the period T1 and L and H levels in the period T2. The logical levels of the selection signals Sa and Sb are shifted to a higher amplitude logical level based on the high voltage signal VHV than the logical levels of the clock signal SCK, the printing data signal SI, the latch signal LAT, and the change signal CH by a level shifter (not illustrated).

The selection circuit 230 is disposed in correspondence with each of the piezoelectric element 60 and the nozzle 651. That is, the number of selection circuits 230 included in one drive signal selection circuit 120 is the same as the total number m of nozzles 651 included in the nozzle group 660.

FIG. 10 is a diagram illustrating a configuration of the selection circuit 230 corresponding to one nozzle 651.

As illustrated in FIG. 10, the selection circuit 230 includes inverters 232*a* and 232*b* that are NOT circuits, and transfer gates 234*a* and 234*b*.

The selection signal Sa from the decoder 226 is supplied to a positive control terminal not denoted by a circle mark in the transfer gate 234*a* and is logically inverted by the inverter 232*a* and supplied to a negative control terminal denoted by a circle mark in the transfer gate 234*a*. Similarly, the selection signal Sb is supplied to a positive control terminal of the transfer gate 234*b* and is logically inverted by the inverter 232*b* and supplied to a negative control terminal of the transfer gate 234*b*.

The drive signal COMA is supplied to an input terminal of the transfer gate 234*a*. The drive signal COMB is supplied to an input terminal of the transfer gate 234*b*. Output terminals of the transfer gates 234*a* and 234*b* are coupled to each other in common. The drive signal VOUT is output to the ejecting unit 600 through the common coupling terminal.

In the transfer gate 234*a*, the input terminal and output terminal are conducted (ON) when the selection signal Sa is at H level. The input terminal and the output terminal are not conducted (OFF) when the selection signal Sa is at L level. The same applies to the transfer gate 234*b*. The ON or OFF state between the input terminal and the output terminal is set depending on the selection signal Sb.

Figure 11:
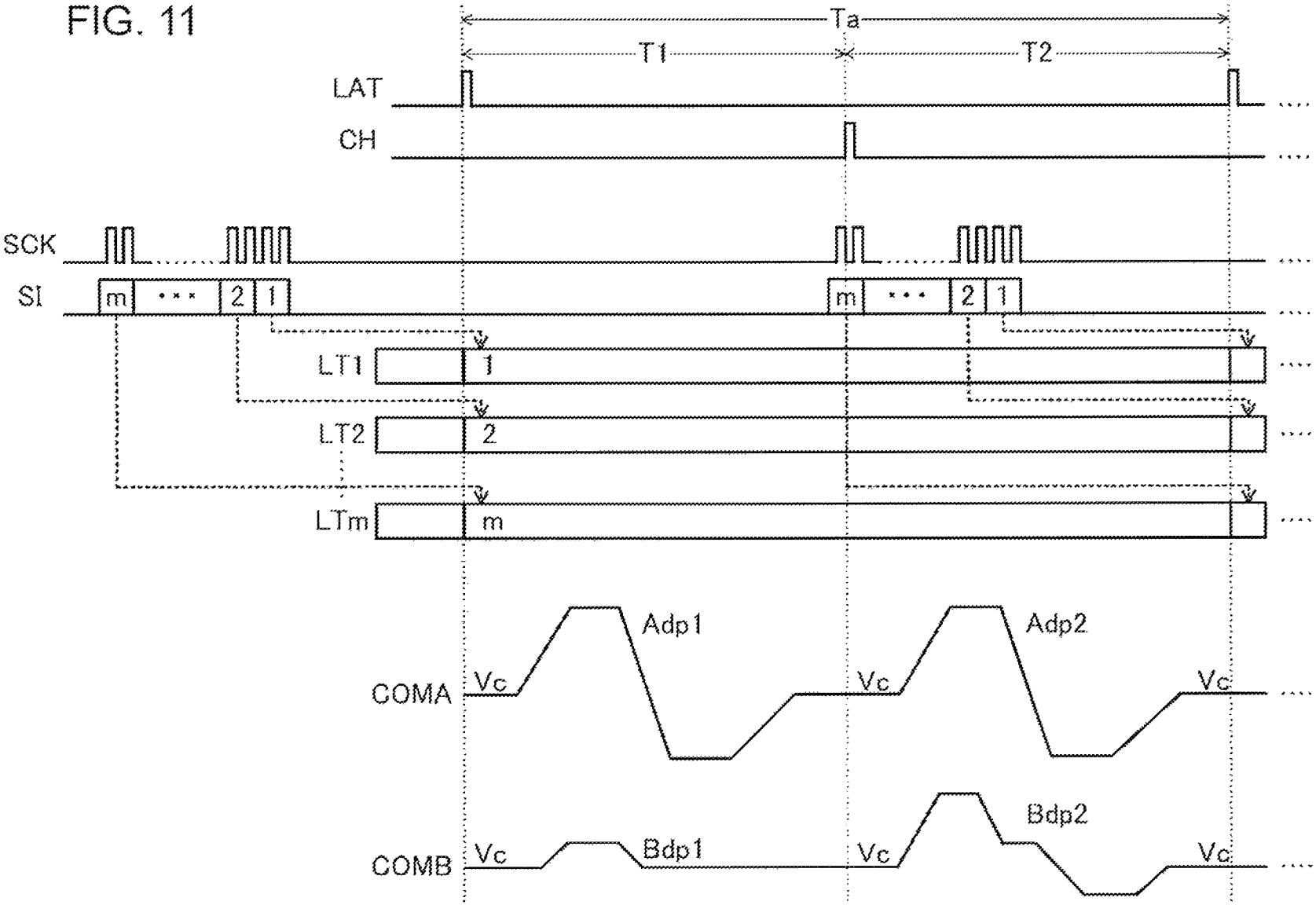
FIG. 11 is a diagram for describing an operation of the drive signal selection circuit.

Next, an operation of the drive signal selection circuit 120 will be described with reference to FIG. 11.

The printing data signal SI is serially supplied in synchronization with the clock signal SCK and is sequentially transferred in the shift register 222 corresponding to the nozzle. When the supply of the clock signal SCK is stopped, each shift register 222 is in a state where the 2-bit printing data [SIH, SIL] corresponding to the nozzle 651 is held in the shift register 222. The printing data signal SI is supplied in order corresponding to the nozzles of the last m-th stage, . . . , the second stage, and the first stage in the shift registers 222.

When the latch signal LAT rises, each latch circuit 224 latches the 2-bit printing data [SIH, SIL] held in the shift register 222 at the same time. In FIG. 11, LT1, LT2, . . . , LTm denote the 2-bit printing data [SIH, SIL] latched by the latch circuits 224 corresponding to the first stage, the second stage, . . . , the m-th stage of the shift registers 222.

The decoder 226 outputs the logical levels of the selection signals Sa and Sb in each of the periods T1 and T2 using the content illustrated in FIG. 9 depending on the size of the dot defined in the latched 2-bit printing data [SIH, SIL].

That is, when the printing data [SIH, SIL] is [1,1] and defines the size of the large dot, the decoder 226 sets the selection signals Sa and Sb at H and L levels in the period T1 and H and L levels in the period T2. In addition, when the printing data [SIH, SIL] is [1, 0] and defines the size of the medium dot, the decoder 226 sets the selection signals Sa and Sb at H and L levels in the period T1 and L and H levels in the period T2. In addition, when the printing data [SIH, SIL] is [0, 1] and defines the size of the small dot, the decoder 226 sets the selection signals Sa and Sb at L and L levels in the period T1 and L and H levels in the period T2. In addition, when the printing data [SIH, SIL] is [0, 0] and defines no recording, the decoder 226 sets the selection signals Sa and Sb at L and H levels in the period T1 and L and L levels in the period T2.

When the printing data [SIH, SIL] is [1, 1], the selection circuit 230 selects the trapezoidal waveform Adp1 included in the drive signal COMA in the period T1 since the selection signals Sa and Sb are at H and L levels. The selection circuit 230 selects the trapezoidal waveform Adp2 included in the drive signal COMA in the period T2 since Sa and Sb are at H and L levels. Consequently, the drive signal VOUT corresponding to "large dot" illustrated in FIG. 7 is generated.

In addition, when the printing data [SIH, SIL] is [1, 0], the selection circuit 230 selects the trapezoidal waveform Adp1 included in the drive signal COMA in the period T1 since the selection signals Sa and Sb are at H and L levels. The selection circuit 230 selects the trapezoidal waveform Bdp2 included in the drive signal COMB in the period T2 since Sa and Sb are at L and H levels. Consequently, the drive signal VOUT corresponding to "medium dot" illustrated in FIG. 7 is generated.

In addition, when the printing data [SIH, SIL] is [0, 1], the selection circuit 230 does not select any of the drive signals COMA and COMB in the period T1 since the selection signals Sa and Sb are at L and L levels. The selection circuit 230 selects the trapezoidal waveform Bdp2 included in the drive signal COMB in the period T2 since Sa and Sb are at L and H levels. Consequently, the drive signal VOUT corresponding to "small dot" illustrated in FIG. 7 is generated. Since any of the drive signals COMA and comb is not selected in the period T1, one end of the piezoelectric element 60 is open. However, the drive signal VOUT is held at the immediately previous voltage Vc by the capacitance of the piezoelectric element 60.

In addition, when the printing data [SIH, SIL] is [0, 0], the selection circuit 230 selects the trapezoidal waveform Bdp1 included in the drive signal COMB in the period T1 since the selection signals Sa and Sb are at L and H levels. The selection circuit 230 does not select any of the drive signals COMA and COMB in the period T2 since Sa and Sb are at L and L levels. Consequently, the drive signal VOUT corresponding to "no recording" illustrated in FIG. 7 is generated. Since any of the drive signals COMA and COMB is not selected in the period T2, one end of the piezoelectric element 60 is open. However, the drive signal VOUT is held at the immediately previous voltage Vc by the capacitance of the piezoelectric element 60.

1.6 Configuration of Drive Circuit

Figure 12:
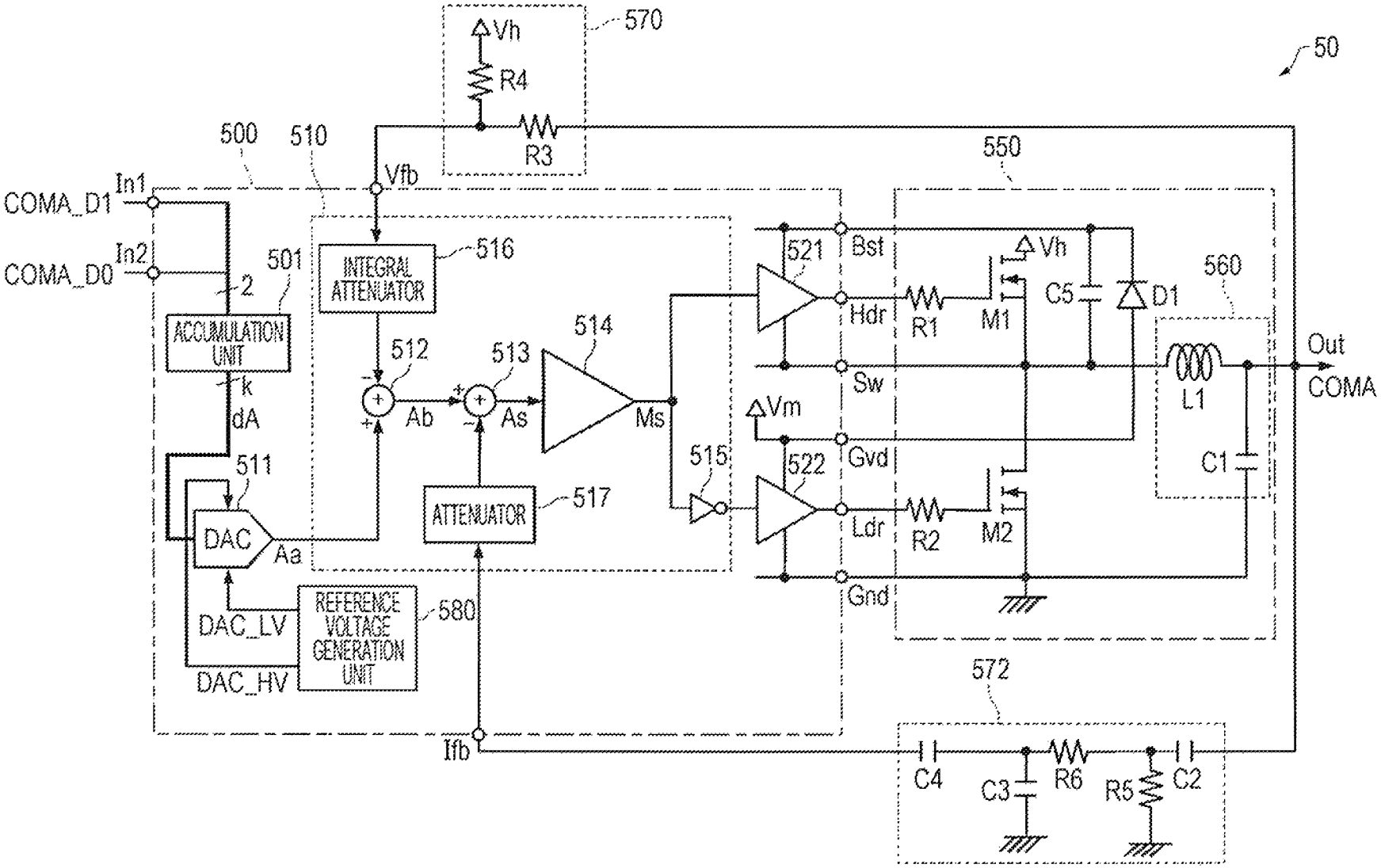
FIG. 12 is a diagram illustrating a circuit configuration of a drive circuit.

Next, a configuration and an operation of the drive circuit 50 generating and outputting the drive signals COMA and COMB will be described. FIG. 12 is a diagram illustrating a circuit configuration of the drive circuit 50. In the following description, digital data supplied to the drive circuit 50 will be described as the drive data COMA_D0 and COMA_D1. Accordingly, a signal output by the drive circuit 50 will be described as the drive signal COMA. When the signal output by the drive circuit 50 is the drive signal COMB, the only difference is the supplied digital data that is the drive data COMB_D0 and COMB_D1, and the configuration and the operation are the same. Accordingly, such a description will not be provided.

As illustrated in FIG. 12, the drive circuit 50 includes an integrated circuit device 500, an output circuit 550, a first feedback circuit 570, and a second feedback circuit 572.

The integrated circuit device 500 outputs gate signals for driving transistors M1 and M2 based on the 2-bit drive data COMA_D0 and COMA_D1 input through terminals In1 and In2. The integrated circuit device 500 includes an accumulation unit 501, a digital to analog converter (DAC) 511, adders 512 and 513, a comparator 514, an inverter 515, an integral attenuator 516, an attenuator 517, gate drivers 521 and 522, and a reference voltage generation unit 580.

The reference voltage generation unit 580 generates a first reference voltage DAC_HV as a high voltage side reference voltage and a second reference voltage DAC_LV as a low voltage side reference voltage and supplies the first reference voltage DAC_HV and the second reference voltage DAC_LV to the DAC 511.

The accumulation unit 501 accumulates the 2-bit drive data COMA_D0 and COMA_D1 and supplies accumulated k-bit drive data dA defining the waveform of the drive signal COMA to the DAC 511.

The DAC 511 converts the k-bit drive data dA into an original drive signal Aa having a voltage between the first reference voltage DAC_HV and the second reference voltage DAC_LV and supplies the original drive signal Aa to an input terminal (+) of the adder 512. A signal acquired by amplifying the voltage of the original drive signal Aa is the drive signal COMA. That is, the original drive signal Aa is a target signal before amplification to the drive signal COMA.

The integral attenuator 516 attenuates and integrates a voltage of a terminal Out input through a terminal Vfb, that is, the drive signal COMA, and supplies the voltage to an input terminal (−) of the adder 512. In obtaining of a deviation between the original drive signal Aa and the drive signal COMA, the integral attenuator 516 attenuates the voltage of the high voltage drive signal COMA with respect to the original drive signal Aa in order to match the amplitude ranges of both voltages.

The adder 512 supplies a signal Ab to an input terminal (+) of the adder 513. The signal Ab has a voltage acquired by subtracting the voltage of the input terminal (−) from the voltage of the input terminal (+) and integrating the difference.

The attenuator 517 attenuates a high frequency component of the drive signal COMA input through a terminal Ifb and supplies the high frequency component to an input terminal (−) of the adder 513. The function of the attenuator 517 is adjustment of a modulation gain. That is, the attenuator 517 adjusts the amount of change in the frequency or duty ratio of a modulation signal Ms that changes in accordance with the drive data dA.

The adder 513 supplies a signal As to the comparator 514. The signal As has a voltage acquired by subtracting the voltage of the input terminal (−) from the voltage of the input terminal (+). The voltage of the signal As output from the adder 513 is a signal in which a deviation acquired by subtracting the attenuated voltage of the drive signal COMA output from the terminal Out from the voltage of the original drive signal Aa of a target is corrected using the high frequency component of the drive signal COMA.

The comparator 514 outputs the modulation signal Ms acquired by performing pulse modulation based on the voltage subtracted by the adder 513. The comparator 514 outputs the modulation signal Ms that is set to be at H level at the time of increase in the voltage of the signal As output from the adder 513 when the signal As becomes greater than or equal to a voltage threshold Vth1, and that is set to be at L level at the time of decrease in the voltage of the signal As when the signal As becomes less than a voltage threshold Vth2. The voltage thresholds are set to be in a relationship of Vth1>Vth2.

The modulation signal Ms acquired by pulse modulation by the comparator 514 is supplied to the gate driver 521. In addition, the modulation signal Ms is supplied to the gate driver 522 through logical inversion by the inverter 515. Thus, signals having logical levels exclusive with each other are supplied to the gate driver 521 and the gate driver 522. The exclusive signals may be signals of which the timings are controlled such that the logical levels of the signals supplied to the gate driver 521 and the gate driver 522 are not at H level at the same time. That is, a meaning of control such that the transistor M1 and the transistor M2 are net ON at the same time is included.

The adder 512, the adder 513, the comparator 514, the inverter 515, the integral attenuator 516, and the attenuator 517 function as a modulation unit 510 that generates the modulation signal Ms by modulating the original drive signal Aa.

The gate driver 521 shifts the level of the voltage value of the modulation signal Ms output from the comparator 514 and outputs the modulation signal Ms from a terminal Hdr. Specifically, a voltage is supplied through a terminal Bst on a high potential side of the power supply voltage of the gate driver 521, and a voltage is supplied through a terminal Sw on a low potential side of the power supply voltage of the gate driver 521. The terminal Bst is coupled in common to one end of a capacitor C5 disposed outside the integrated circuit device 500 and a cathode terminal of a diode D1 for preventing a reverse current. In addition, another end of the capacitor C5 is coupled to the terminal Sw. In addition, an anode terminal of the diode D1 is coupled to a terminal Gvd to which a voltage Vm of the power supply voltage signal GVDD supplied from the voltage conversion circuit 114 illustrated in FIG. 4 is supplied. Accordingly, a difference in potential between the terminal Bst and the terminal Sw is approximately equal to a difference in potential between both ends of the capacitor C5, that is, the voltage Vm. The gate driver 521 generates a signal having a voltage value greater by the voltage Vm than that of the terminal Sw in accordance with the input modulation signal Ms and outputs the signal from the terminal Hdr.

The gate driver 522 operates on a lower potential side than the gate driver 521. The gate driver 522 shifts the level of the voltage value of a signal acquired by inverting the modulation signal Ms output from the comparator 514 by the inverter 515, and outputs the signal from a terminal Ldr. Specifically, the voltage Vm is supplied to a high potential side of the power supply voltage of the gate driver 522, and the ground potential is supplied to a low potential side of the power supply voltage of the gate driver 522. The gate driver 522 generates a signal having a voltage value greater by the voltage Vm than that of a terminal Gnd in accordance with the input inverted signal of the modulation signal Ms and outputs the signal from the terminal Ldr.

The output circuit 550 includes the transistors M1 and M2, resistors R1 and R2, and a low pass filter circuit (low pass filter) 560. For example, each of the transistors M1 and M2 is an N channel type field effect transistor (FET).

A voltage Vh of the high voltage signal VHV is supplied to a drain electrode of the transistor M1. In addition, a gate electrode of the transistor M1 is coupled to one end of the resistor R1, and another end of the resistor R1 is coupled to the terminal Hdr. In addition, a source electrode of the transistor M1 is coupled to the terminal Sw. The transistor M1 coupled as described above operates depending on the output signal of the gate driver 521 output from the terminal Hdr.

A drain electrode of the transistor M2 is coupled to the source electrode of the transistor M1. In addition, a gate electrode of the transistor M2 is coupled to one end of the resistor R2, and another end of the resistor R2 is coupled to the terminal Ldr. In addition, the ground potential is supplied to a source electrode of the transistor M2. The transistor M2 coupled as described above operates depending on the output signal of the gate driver 522 output from the terminal Ldr.

When the transistor M1 is controlled to be OFF, and the transistor M2 is controlled to be ON, the coupling point to which the terminal Sw is coupled has the ground potential, and the voltage Vm is supplied to the terminal Bst. When the transistor Ml is controlled to be ON, and the transistor M2 is controlled to be OFF, the voltage Vh is supplied to the coupling point to which the terminal Sw is coupled. Thus, the terminal Bst is supplied with the voltage Vh+voltage Vm.

That is, the gate driver 521 driving the transistor M1 supplies a signal having the voltage Vh as L level and the voltage Vh+voltage Vm as H level to the gate electrode of the transistor M1 due to a change in the voltage of the terminal Sw to the ground potential or the voltage Vh depending on the operations of the transistors M1 and M2 with the capacitor C5 as a floating power supply. The transistor M1 performs a switching operation based on the signal supplied to the gate electrode. In addition, the gate driver 522 driving the transistor M2 supplies a signal having the ground potential as L level and the voltage Vm as H level to the gate electrode of the transistor M2 regardless of the operations of the transistors M1 and M2. The transistor M2 performs a switching operation based on the signal supplied to the gate electrode. Accordingly, an amplified modulation signal acquired by amplifying the modulation signal Ms based on the voltage Vh is generated at the coupling point between the source electrode of the transistor M1 and the drain electrode of the transistor M2.

The low pass filter circuit 560 includes an inductor L1 and a capacitor C1.

One end of the inductor L1 is coupled in common to the source electrode of the transistor M1 and the drain electrode of the transistor M2. In addition, another end of the inductor L1 is coupled in common to the terminal Out from which the drive signal COMA is output, and one end of the capacitor C1. The ground potential is supplied to another end of the capacitor C1.

The inductor L1 and the capacitor C1 coupled as described above smooth the amplified modulation signal supplied to the coupling point between the transistors M1 and M2. Accordingly, the amplified modulation signal is demodulated, and the drive signal COMA is generated. The generated drive signal COMA is output from the terminal Out.

In addition, the drive circuit 50 includes the first feedback circuit 570 and the second feedback circuit 572 for increasing the frequency of self-exciting oscillation such that the accuracy of the drive signal COMA can be sufficiently secured.

The first feedback circuit 570 includes resistors R3 and R4. One end of the resistor R3 is coupled to the terminal Out. In addition, another end of the resistor R3 is coupled in common to the terminal Vfb and one end of the resistor R4. The voltage Vh is supplied to another end of the resistor R4. Accordingly, the drive signal COMA passing through the first feedback circuit 570 from the terminal Out is pulled up and fed back to the terminal Vfb.

The second feedback circuit 572 includes resistors R5 and R6 and capacitors C2, C3, and C4. One end of the capacitor C2 is coupled to the terminal Out. In addition, another end of the capacitor C2 is coupled in common to one end of the resistor R5 and one end of the resistor R6. The ground potential is supplied to another end of the resistor R5. Accordingly, the capacitor C2 and the resistor R5 function as a high pass filter. In addition, another end of the resistor R6 is coupled in common to one end of the capacitor C3 and one end of the capacitor C4. The ground potential is supplied to another end of the capacitor C3. Accordingly, the resistor R6 and the capacitor C3 function as a low pass filter. The second feedback circuit 572 functions as a band pass filter that passes a predetermined frequency range of the drive signal COMA. Another end of the capacitor C4 is coupled to the terminal Ifb. Accordingly, a direct current component in the high frequency component of the drive signal COMA passing through the second feedback circuit 572 is cut and fed back to the terminal Ifb.

1.7 Cable Group and Configuration and Coupling of Cable

Figure 13:
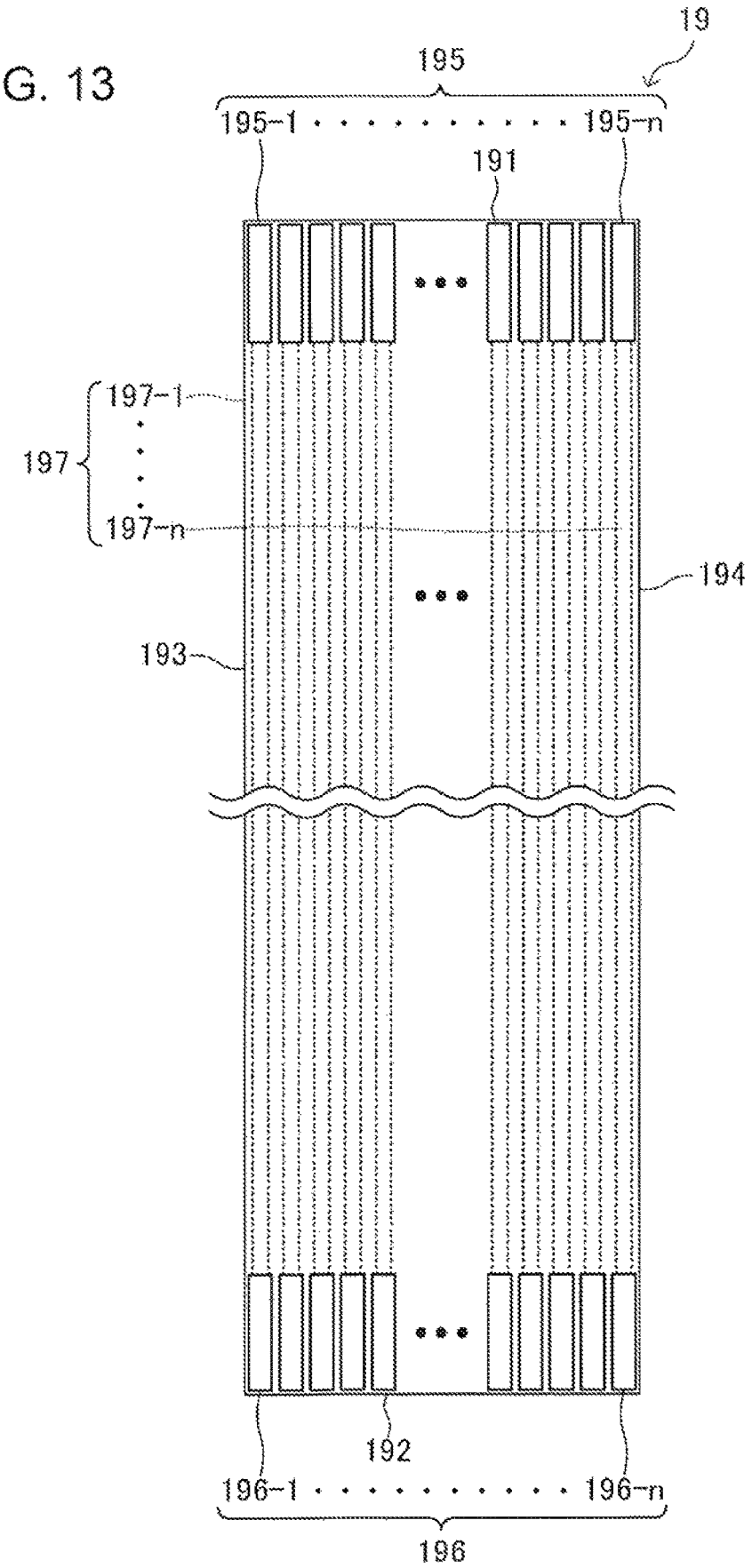
FIG. 13 is a diagram illustrating a configuration of a cable.

A configuration of the cable 19 electrically coupling the control substrate 100, the drive circuit substrate 101, and the head substrate 104 to each other will be described using FIG. 13. FIG. 13 is a diagram illustrating a configuration of the cable 19. The cable 19 has an approximately rectangular shape having short edges 191 and 192 facing each other and long edges 193 and 194 facing each other. For example, the cable 19 is a flexible flat cable (FFC).

On the short edge 151 side of the cable 19, a plurality of terminals 195 are linearly disposed from the long edge 193 side toward the long edge 194 side along the short edge 191. Specifically, n terminals 195-1 to **195-*n* are linearly disposed from the long edge 193 side toward the long edge 194 side along the short edge 191. In addition, on the short edge 192 side of the cable 19, a plurality of terminals 196 are linearly disposed from the long edge 193 side toward the long edge 194 side along the short edge 192. Specifically, n terminals 196-1 to 196-*n* are linearly disposed from the long edge 193 side toward the long edge 194 side along the short edge 192. In addition, in the cable 19, a plurality of wires 197 that electrically couple the plurality of terminals 195 to the plurality of terminals 196 respectively are linearly disposed from the long edge 193 side toward the long edge 194 side. Specifically, a wire 197-*i* (i is any of 1 to n) electrically couples a terminal 195-*i* to a terminal 196-*i*. In the cable 19 configured as described above, for example, various signals input from the terminal 195-*i* are propagated by being output from the terminal 196-*i* through the wire 197-*i*. The configuration of the cable 19 illustrated in FIG. 13 is one example and is not for limitation purposes. For example. the plurality of terminals 195 and the plurality of terminals 196 may be disposed on different surfaces of the cable 19** or may be disposed on both of the surface and the rear surface.

Figure 14:
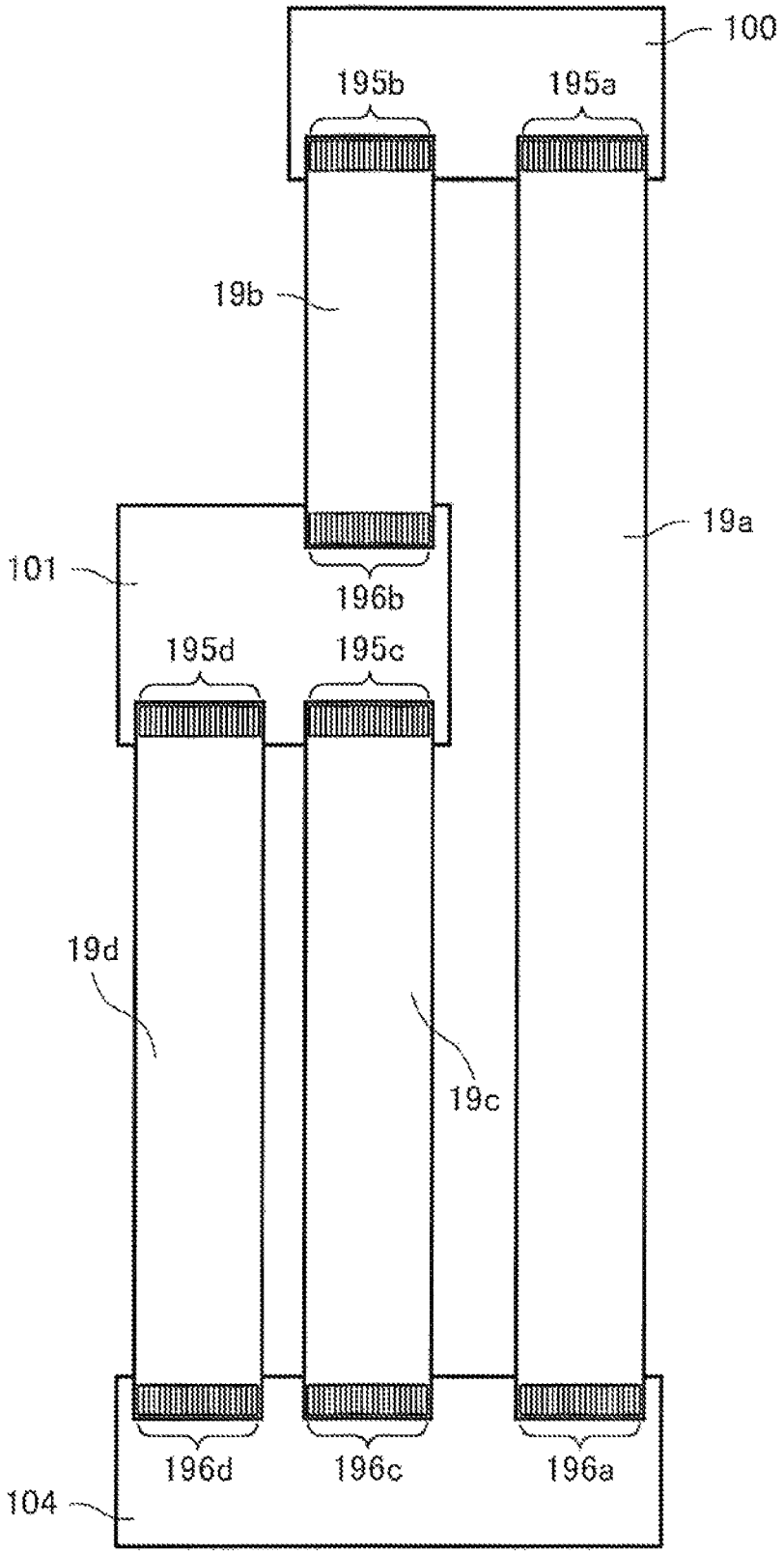
FIG. 14 is a diagram illustrating a coupling relationship among a control substrate, a drive circuit substrate, a head substrate, and a plurality of cables.

Next, a coupling relationship among the control substrate 100, the drive circuit substrate 101, the head substrate 104, and the plurality of cables 19 will be described using FIG. 14. FIG. 14 is a diagram illustrating the coupling relationship among the control substrate 100, the drive circuit substrate 101, the head substrate 104, and the plurality of cables 19. FIG. 14 conceptually illustrates the coupling relationship among the control substrate 100, the drive circuit substrate 101, the head substrate 104, and the plurality of cables 19. The control substrate 100, the drive circuit substrate 101, the head substrate 104, and the plurality of cables 19 are not limited to the arrangement illustrated in FIG. 14.

In the following description, the plurality of cables 19 will be respectively referred to as cables **19*a*, 19*b*, 19*c*, and 19*d* in order to distinguish each of plurality of cables 19. The plurality of terminals 195 and 196 included in the cable 19*a* will be respectively referred to as terminals 195*a* and 196*a*, and the plurality of wires 197 included in the cable 19*a* will be referred to as wires 197*a*. Similarly, the plurality of terminals 195 and 196 included in the cable 19*b* will be respectively referred to as terminals 195*b* and 196*b*, and the plurality of wires 197 included in the cable 19*b* will be referred to as wires 197*b*. Similarly, the plurality of terminals 195 and 196 included in the cable 19*c* will be respectively referred to as terminals 195***c* and 196*c*, and the plurality of wires 197 included in the cable 19*c* will be referred to as wires 197*c*. Similarly, the plurality of terminals 195 and 196 included in the cable 19*d* will be respectively referred to as terminals 195*d* and 196*d*, and the plurality of wires 197 included in the cable 19*d* will be referred to as wires 197*a*.

In addition, while illustration and description, are not provided, for example, each of the plurality of terminals 195 and 196 of the cable 19 may be electrically coupled to the control substrate 100, the drive circuit substrate 101, and the head substrate 104 through a connector. In addition, each of the plurality of terminals 195 and 196 of the cable 19 may be electrically coupled to the control substrate 100, the drive circuit substrate 101, and the head substrate 104 through solder or the like.

As illustrated in FIG. 14, the cable 19*a* electrically couples the control substrate 100 to the head substrate 104. The cable 19*a* propagates the differential signals [SI1+, SI1−] to [SI6+, SI6−], [LAT+, LAT−], [CH+, CH−], and [SCK+, SCK−] illustrated in FIG. 3 to the head substrate 104 from the control substrate 100. Specifically, by electrically coupling the plurality of terminals 195*a* included in the cable 19*a* to the control substrate 100, each of the differential signals [SI1+, SI1−] to [SI6+, SI6−], [LAT+, LAT−], [CH+, CH−], and [SCK+, SCK−] generated in various configurations mounted on the control substrate 100 is input into the cable 19*a*. The differential signals are propagated through the plurality of wires 197*a* and then, are output to the head substrate 104 from the plurality of terminals 196*a*.

In addition, the cable 19*b* electrically couples the control substrate 100 to the drive circuit substrate 101. The cable 19*b* propagates the drive data COMA_D0, COMA_D1, COMB_D0, and COMB_D1, the high voltage signal VHV, and the ground voltage signal GND illustrated in FIG. 3 to the drive circuit substrate 101 from the control substrate 100. Specifically, by electrically coupling the plurality of terminals 195*b* included in the cable 19*b* to the control substrate 100, each of the drive data COMA_D0, COMA_D1, COMB_D0, and COMB_D1, the high voltage signal VHV, and the ground voltage signal GND generated in various configurations mounted on the control substrate 100 is input into the cable 19*b*. The signals are propagated through the plurality of wires 197*b* and then, are output to the head substrate 104 from the plurality of terminals 196*b*.

In addition, the cables 19*c* and 19*a* electrically couple the drive circuit substrate 101 to the head substrate 104. The cables 19*c* and 19*d* propagate the drive signals COMA1 to COMA6 and COMB1 to COMB6, the reference voltage signals VBS1 to VBS6, the high voltage signal VHV, the low voltage signal VDD, and the ground voltage signal GND to the head substrate 104 from the drive circuit substrate 101 illustrated in FIG. 3. Specifically, by electrically coupling each of the plurality of terminals 195*c* and 195*d* respectively included in the cables 19*c* and 19*d* to the drive circuit substrate 101 and electrically coupling each of the plurality of terminals 196*c* and 196*d* to the head substrate 104, each of the drive signals COMA1 to COMA6 and COMB1 to COMB6, the reference voltage signals VBS1 to VBS6, the high voltage signal VHV, the low voltage signal VDD, and the ground voltage signal GND generated in various configurations mounted on the drive circuit substrate 101 is input into the cables 19*c* and 19*d*. The signals are propagated through the plurality of wires 197*c* and 197*d* and then, are output to the head substrate 104 from the plurality of terminals 196*c* and 196*d*.

Figure 17:
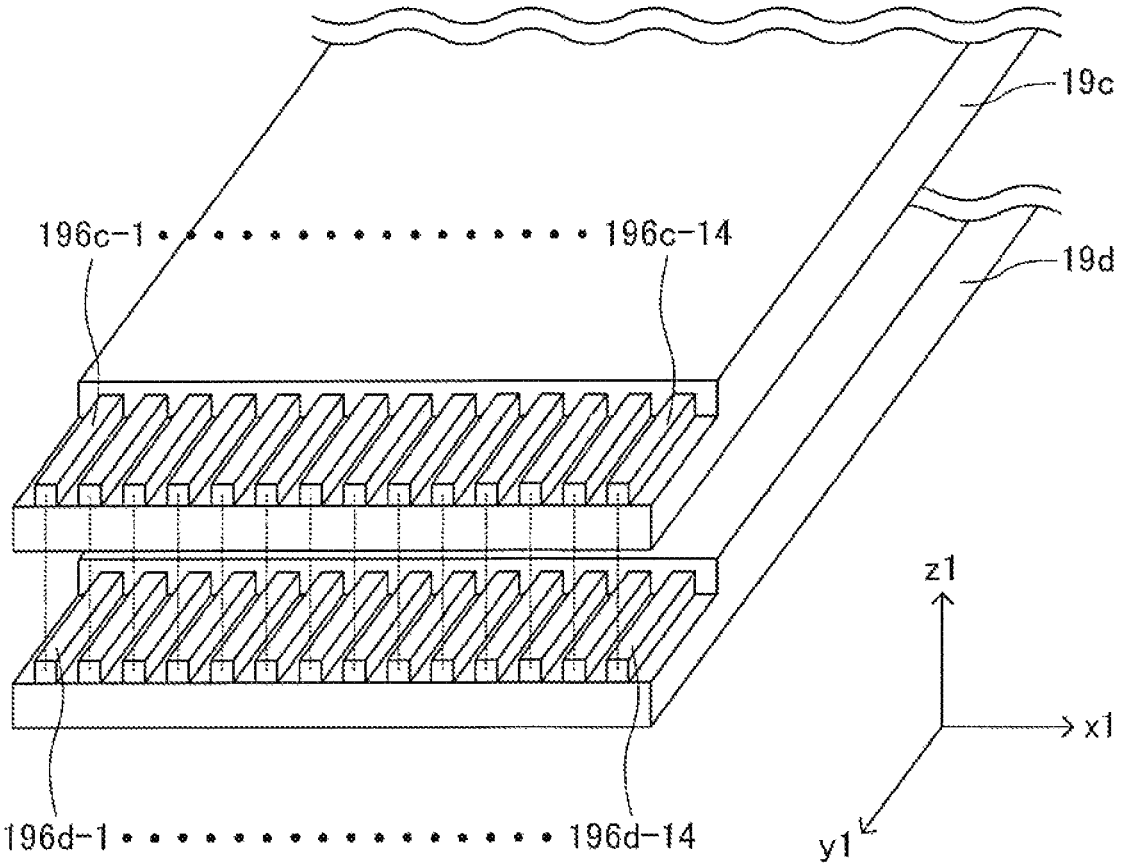
FIG. 17 is a diagram for describing mutual arrangement of the cables.

Next, configurations of the cables 19*c* and 19*d* propagating the drive signals COMA and COMB will be described using FIG. 15 to FIG. 17. As illustrated in FIG. 15 to FIG. 17, the cables 19*c* and 19*d* in the first embodiment include 14 terminals 195, 14 terminals 196, and 14 wires 197.

The cable 19*c* includes a terminal 196*c*-2 from which the drive signal COMA1 in the drive signal VOUT1 input into one end of the piezoelectric element 60 included in the first nozzle group 660*a* from the drive circuit 50*a* is output, a terminal 196*c*-4 from which the drive signal COMB2 in the drive signal VOUT2 input into one end of the piezoelectric element 60 included in the second nozzle group 660*b* from the drive circuit 50*b* is output, and a terminal 196*c*-6 from which the drive signal COMA3 in the drive signal VOUT3 input into one end of the piezoelectric element 60 included in the third nozzle group 660*c* from the drive circuit 50*a* is output.

The cable 19*d* includes a terminal 196*d*-3 from which the drive signal COMB1 in the drive signal VOUT1 input into one end of the piezoelectric element 60 included in the first nozzle group 660*a* from the drive circuit 50*b* is output, a terminal 196*d*-5 from which the drive signal COMA2 in the drive signal VOUT2 input into one end of the piezoelectric element 60 included in the second nozzle group 660*b* from the drive circuit 50*a* is output, a terminal 196*d*-7 from which the drive signal COMA3 in the drive signal VOUT3 input into one end of the piezoelectric element 60 included in the third nozzle group 660*c* from the drive circuit 50*b* is output, a terminal 196*d*-2 from which the reference voltage signal VBS1 input into the other end of the piezoelectric element 60 included in the first nozzle group 660*a* is output, and a terminal 196*d*-4 from which the reference voltage signal VBS2 input into the other end of the piezoelectric element 60 included in the second nozzle group 660*b* is output.

The terminal 196*c*-4 is disposed between the terminal 196*c*-2 and the terminal 196*c*-6. The terminal 196*d*-5 is disposed between the terminal 196*d*-3 and the terminal 196*d*-7. The cable 19*c* and the cable 19*d* are disposed in an overlapping manner in a direction orthogonal to a direction in which the terminal 196*c*-2 and the terminal 196*c*-4 are lined up.

Furthermore, in the cable 19*d*, the terminal 196*d*-4 is disposed between the terminal 196*d*-3 and the terminal 196*d*-5. The terminal 196*d*-3 is disposed between the terminal 196*d*-2 and the terminal 196*d*-4. In the cable 19*c* and the cable 19*d*, the terminal 196*c*-2 and the terminal 196*d*-2 are disposed to at least partially overlap with each other, and the terminal 196*c*-4 and the terminal 196*d*-4 are disposed to at least partially overlap with each other.

Details will be described using the drawings. First, a specific example of signals propagated through each of the terminals 195 and 196 and the wire 197 of the cable 19*c* and the cable 19*d* will be described using FIG. 15 and FIG. 16. FIG. 15 is a diagram illustrating a specific example of a signal propagated through the cable 19*c*. In addition, FIG. 16 is a diagram illustrating a specific example of a signal propagated through the cable 19*d*.

As illustrated in FIG. 15, the plurality of drive signals COMA and COMB, the plurality of reference voltage signals VBS, the low voltage signal VDD, and the ground voltage signal GND are propagated through the cable 19*c*.

Specifically, the ground voltage signal GND is input into a terminal 195*c*-1. The ground voltage signal GND is propagated through a wire 197*c*-1 and is output from a terminal 196*c*-1.

In addition, the drive signal COMA1 is input into a terminal 195*c*-2. The drive signal COMA1 is propagated through a wire 197*c*-2 and is output from the terminal 196*c*-2. The reference voltage signal VBS1 is input into a terminal 195*c*-3. The reference voltage signal VBS1 is propagated through a wire 197*c*-3 and is output from a terminal 196*c*-3. That is, the drive signal COMA1 and the reference voltage signal VBS1 supplied to the piezoelectric element 60 included in the first nozzle group 660*a* are propagated through the wire 197*c*-2 and the wire 197*c*-3.

In addition, the drive signal COMB2 is input into a terminal 195*c*-4. The drive signal COMB2 is propagated through a wire 197*c*-4 and is output from the terminal 196*c*-4. The reference voltage signal VBS2 is input into a terminal 195*c*-5. The reference voltage signal VBS2 is propagated through a wire 197*c*-5 and is output from a terminal 196*c*-5. That is, the drive signal COMB2 and the reference voltage signal VBS2 supplied to the piezoelectric element 60 included in the second nozzle group 660*b* are propagated through the wire 197*c*-4 and the wire 197*c*-5.

In addition, the drive signal COMA3 is input into a terminal 195*c*-6. The drive signal COMA3 is propagated through a wire 197*c*-6 and is output from the terminal 196*c*-6. The reference voltage signal VBS3 is input into a terminal 195*c*-7. The reference voltage signal VBS3 is propagated through a wire 197*c*-7 and is output from a terminal 196*c*-7. That is, the drive signal COMA3 and the reference voltage signal VBS3 supplied to the piezoelectric element 60 included in the third nozzle group 660*c* are propagated through the wire 197*c*-6 and the wire 197*c*-7.

In addition, the drive signal COMB4 is input into a terminal 195*c*-8. The drive signal COMB4 is propagated through a wire 197*c*-8 and is output from a terminal 196*c*-8. The reference voltage signal VBS4 is input into a terminal 195*c*-9. The reference voltage signal VBS4 is propagated through a wire 197*c*-9 and is output from a terminal 196*c*-9. That is, the drive signal COMB4 and the reference voltage signal VBS4 supplied to the piezoelectric element 60 included in the fourth nozzle group 660*d* are propagated through the wire 197*c*-8 and the wire 197*c*-9.

In addition, the drive signal COMA5 is input into a terminal 195*c*-10. The drive signal COMA5 is propagated through a wire 197*c*-10 and is output from a terminal 196*c*-10. The reference voltage signal VBS5 is input into a terminal 195*c*-11. The reference voltage signal VBS5 is propagated through a wire 197*c*-11 and is output from a terminal 196*c*-11. That is, the drive signal COMA5 and the reference voltage signal VBS5 supplied to the piezoelectric element 60 included in the fifth nozzle group 660*e* are propagated through the wire 197*c*-10 and the wire 197*c*-11.

In addition, the drive signal COMB6 is input into a terminal 195*c*-12. The drive signal COMB6 is propagated through a wire 197*c*-12 and is output from a terminal 196*c*-12. The reference voltage signal VBS6 is input into a terminal 195*c*-13. The reference voltage signal VBS6 is propagated through a wire 197*c*-13 and is output from a terminal 196*c*-13. That is, the drive signal COMB6 and the reference voltage signal VBS6 supplied to the piezoelectric element 60 included in the sixth nozzle group 660*f* are propagated through the wire 197*c*-12 and the wire 197*c*-13.

In addition, the low voltage signal VDD is input into a terminal 195*c*-14. The low voltage signal VDD is propagated through a wire 197*c*-14 and is output from a terminal 196*c*-14.

As described above, in the cable 19*c*, the drive signal COMA or the drive signal COMB and the reference voltage signal VBS supplied for each of the plurality of nozzle groups 660 disposed in the ejecting head 21 are closely positioned. Furthermore, the supplied drive signal COMA and the drive signal COMB are alternately provided for each of the adjacent nozzle groups. The cable 19*c* is one example of a first cable. The terminal 196*c*-2 included in the cable 19*c* is one example of a first terminal. The terminal 196*c*-4 is one example of a second terminal. The terminal 196*c*-6 is one example of a third terminal.

As illustrated in FIG. 16, the plurality of drive signals COMA and COMB, the plurality of reference voltage signals VBS, the high voltage signal VHV, and the ground voltage signal GND are propagated through the cable 19*d*.

Specifically, the high voltage signal VHV is input into a terminal 195*d*-1. The high voltage signal VHV is propagated through a wire 197*d*-1 and is output from a terminal 196*d*-1.

In addition, the reference voltage signal VBS1 is input into a terminal 195*d*-2. The reference voltage signal VBS1 is propagated through a wire 197*d*-2 and is output from the terminal 196*d*-2. The drive signal COMB1 is input into a terminal 195*a*-3. The drive signal COMB1 is propagated through a wire 197*d*-3 and is output from the terminal 196*d*-3. That is, the drive signal COMB1 and the reference voltage signal VBS1 supplied to the piezoelectric element 60 included in the first nozzle group 660*a* are propagated through the wire 197*d*-2 and the wire 197*d*-3.

In addition, the reference voltage signal VBS2 is input into a terminal 195*d*-4. The reference voltage signal VBS2 is propagated through a wire 197*d*-4 and is output from the terminal 196*d*-4. The drive signal COMA2 is input into a terminal 195*d*-5. The drive signal COMA2 is propagated through a wire 197*d*-5 and is output from the terminal 196*d*-5. That is, the drive signal COMA2 and the reference voltage signal VBS2 supplied to the piezoelectric element 60 included in the second nozzle group 660*b* are propagated through the wire 197*d*-4 and the wire 197*d*-5.

In addition, the reference voltage signal VBS3 is input into a terminal 195*d*-6. The reference voltage signal VBS3 is propagated through a wire 197*d*-6 and is output from a terminal 196*d*-6. The drive signal COMB3 is input into a terminal 195*a*-7. The drive signal COMB3 is propagated through a wire 197*d*-7 and is output from the terminal 196*d*-7. That is, the drive signal COMB3 and the reference voltage signal VBS3 supplied to the piezoelectric element 60 included in the third nozzle group 660*c* are propagated through the wire 197*d*-6 and the wire 197*d*-7.

In addition, the reference voltage signal VBS4 is input into a terminal 195*d*-8. The reference voltage signal VBS4 is propagated through a wire 197*d*-8 and is output from a terminal 196*d*-8. The drive signal COMA4 is input into a terminal 195*d*-9. The drive signal COMA4 is propagated through a wire 197*d*-9 and is output from a terminal 196*d*-9. That is, the drive signal COMA4 and the reference voltage signal VBS4 supplied to the piezoelectric element 60 included in the fourth nozzle group 660*d* are propagated through the wire 197*d*-8 and the wire 197*d*-9.

in addition, the reference voltage signal VBS5 is input into a terminal 195*d*-10. The reference voltage signal VBS5 is propagated through a wire 197*d*-10 and is output from a terminal 196*d*-10. The drive signal COMB5 is input into a terminal 195*d*-11. The drive signal COMB5 is propagated through a wire 197*d*-11 and is output from a terminal 196*d*-11. That is, the drive signal COMB5 and the reference voltage signal VBS5 supplied to the piezoelectric element 60 included in the fifth nozzle group 660*e* are propagated through the wire 197*d*-10 and the wire 197*d*-11.

In addition, the reference voltage signal VBS6 is input into a terminal 195*d*-12. The reference voltage signal VBS6 is propagated through a wire 197*d*-12 and is output from a terminal 196*d*-12. The drive signal COMA6 is input into a terminal 195*d*-13. The drive signal COMA6 is propagated through a wire 197*d*-13 and is output from a terminal 196*d*-13. That is, the drive signal COMA6 and the reference voltage signal VBS6 supplied to the piezoelectric element 60 included in the sixth nozzle group 660*f* are propagated through the wire 197*d*-12 and the wire 197*d*-13.

In addition, the ground voltage signal GND is input into a terminal 195*d*-14. The ground voltage signal GND is propagated through a wire 197*d*-14 and is output from a terminal 196*d*-14.

As described above, in the cable 19*d*, the drive signal COMA or the drive signal COMB and the reference voltage signal VBS supplied for each of the plurality of nozzle groups 660 disposed in the ejecting head 21 are closely positioned. Furthermore, the supplied drive signal COMA and the drive signal COMB are alternately provided for each of the adjacent nozzle groups. The cable 19*d* is one example of a second cable. The terminal 196*d*-3 included in the cable 19*d* is one example of a fourth terminal. The terminal 196*a*-5 is one. example of a fifth terminal. The terminal 196*d*-7 is one example of a sixth terminal. The terminal 196*d*-2 is one example of a seventh terminal. The terminal 196*d*-4 is one. example of an eighth terminal. By coupling the drive circuit substrate 101 to the head substrate 104, the cable 19*c* and the cable 19*d* electrically coupling the drive circuits 50*a* and 50*b* to the ejecting head 21 constitute a cable group.

The propagated signals illustrated in FIG. 15 and FIG. 16 are merely for illustrative purposes and not for limitation purposes. For example, the signal propagated through the cable 19*c* may be replaced with the signal propagated through the cable 19*d*.

FIG. 17 is a diagram for describing mutual arrangement of the cables 19*c* and 19*d*. In FIG. 17, the side of the terminals 196*c* and 196*d* on which the cables 19*c* and 19*d* are electrically coupled to the head substrate 104 is illustrated. In addition, directions x1, y1, and z1 that are orthogonal to each other are illustrated in FIG. 17.

As illustrated in FIG. 17, the terminals 196*c*-1 to 196*c*-14 in the end portion of the cable 19*c* are linearly disposed in the direction x1. The wires 197*c*-1 to 197*c*-14 (refer to FIG. 13) respectively corresponding to the terminals 196*c*-1 to 196*c*-14 are disposed in the direction y1. In addition, the terminals 196*d*-1 to 196*d*-14 in the end portion of the cable 19*d* are linearly disposed in the direction x1. The wires 197*d*-1 to 197*d*-14 (refer to FIG. 13) respectively corresponding to the terminals 196*d*-1 to 196*d*-14 are disposed in the direction y1.

The cable 19*c* and the cable 19*d* are disposed in an overlapping manner in the direction z1 orthogonal to the direction x1 in which the terminals 195*c*-1 to 196*c*-14 are lined up. In other words, the cable 19*c* and the cable 19*d* are disposed in an overlapping manner in a plan view. Specifically, a terminal 196*c*-*j* (j is any of 1 to 14) of the cable 19*c* and a terminal 196*d*-*j* of the cable 19*d* are disposed in an overlapping manner in a plan view.

The cable 19*c* and the cable 19*d* are disposed in an overlapping manner in a plan view, and the terminal 196*c*-*j* (j is any of 1 to 14) and the terminal 196*d*-*j* are disposed in an overlapping manner in a plan view. Accordingly, a wire 197*c*-*j* electrically coupled to the terminal 196*c*-*j* and a wire 197*d*-*j* electrically coupled to the terminal 196*d*-*j* can be easily disposed in an overlapping manner.

1.8 Operation Effect

In the liquid ejecting apparatus 1 in the first embodiment described thus far, the cables 19*c* and 19*d* that constitute a cable group and are electrically coupled to the ejecting head 21 are disposed to at least partially overlap with each other. Accordingly, when ink mist floats inside the liquid ejecting apparatus 1, the ink mist may unevenly cling to any of the cables 19*c* and 19*d*. However, in the cable 19*c* in the first embodiment, the terminal 196*c*-4 from which the drive signal COMB output from the drive circuit 50*b* is output is disposed between the terminals 196*c*-2 and 196*c*-6 from which the drive signal COMA output from the drive circuit 50*a* is output. In addition, in the cable 19*d*, the terminal 196*d*-5 from -which the drive signal COMA output from the drive circuit 50*a* is output is disposed between the terminals 196*d*-3 and 196*d*-7 from which the drive signal COMB output from the drive circuit 50*b* is output. In other words, the drive signal COMA output by the drive circuit 50*a* is propagated through both of the cables 19*c* and 19*d*, and the drive signal COMB output by the drive circuit 50*b* is also propagated through both of the cables 19*c* and 19*d*. In each of the cables 19*c* and 19*d*, the drive signal COMA and the drive signal COMB are propagated through alternately disposed wires. Thus, even when ink mist unevenly clings to any of the cables 19*c* and 19*d*, an increase in the output of only any of the drive circuits 50*a* and 50*b* is reduced. Accordingly, the possibility of increase in heat emission of a specific drive circuit is reduced.

In addition, in the liquid ejecting apparatus 1 in the first embodiment, in the cable 19*c*, the terminal 196*c*-2 from which the drive signal COMA1 supplied to one end of the piezoelectric element 60 included in the first nozzle group 660*a* is output can be disposed close to the wire 197*c*-2 electrically coupled to the terminal 196*c*-2. The terminal 196*c*-3 from which the reference voltage signal VBS1 supplied to the other end of the piezoelectric element is output can be disposed close to the wire 197*c*-3 electrically coupled to the terminal 196*c*-3. Currents in opposite directions flow in the wire 197*c*-2 and the wire 197*c*-3. Thus, a magnetic field caused by currents caused by propagation of the drive signal COMA1 through the wire 197*c*-2 and the wire 197*c*-3 is reduced, and an inductance component occurring in the wires can be reduced.

In addition, in the cable 19*d*, the terminal 196*d*-5 from which the drive signal COMA2 supplied to one end of the piezoelectric element 60 included in the second nozzle group 660*b* is output can be disposed close to the wire 197*d*-5 electrically coupled to the terminal 196*d*-5. The terminal 196*d*-4 from which the reference voltage signal VBS2 supplied to the other end of the piezoelectric element is output can be disposed close to the wire 197*d*-4 electrically coupled to the terminal 196*d*-4. Currents in opposite directions flow in the wire 197*d*-4 and the wire 197*d*-5. Thus, a magnetic field caused by currents caused by propagation of the drive signal COMA2 through the wire 197*d*-4 and the wire 197*d*-5 is reduced, and an inductance component occurring in the wires can be reduced.

As described thus far, in the liquid ejecting apparatus 1 in the first embodiment, an inductance component occurring in the cables 19*c* and 19*d* can be reduced. Accordingly, an overshoot of the drive signal COMA caused by the inductance component can be reduced.

Figure 18:
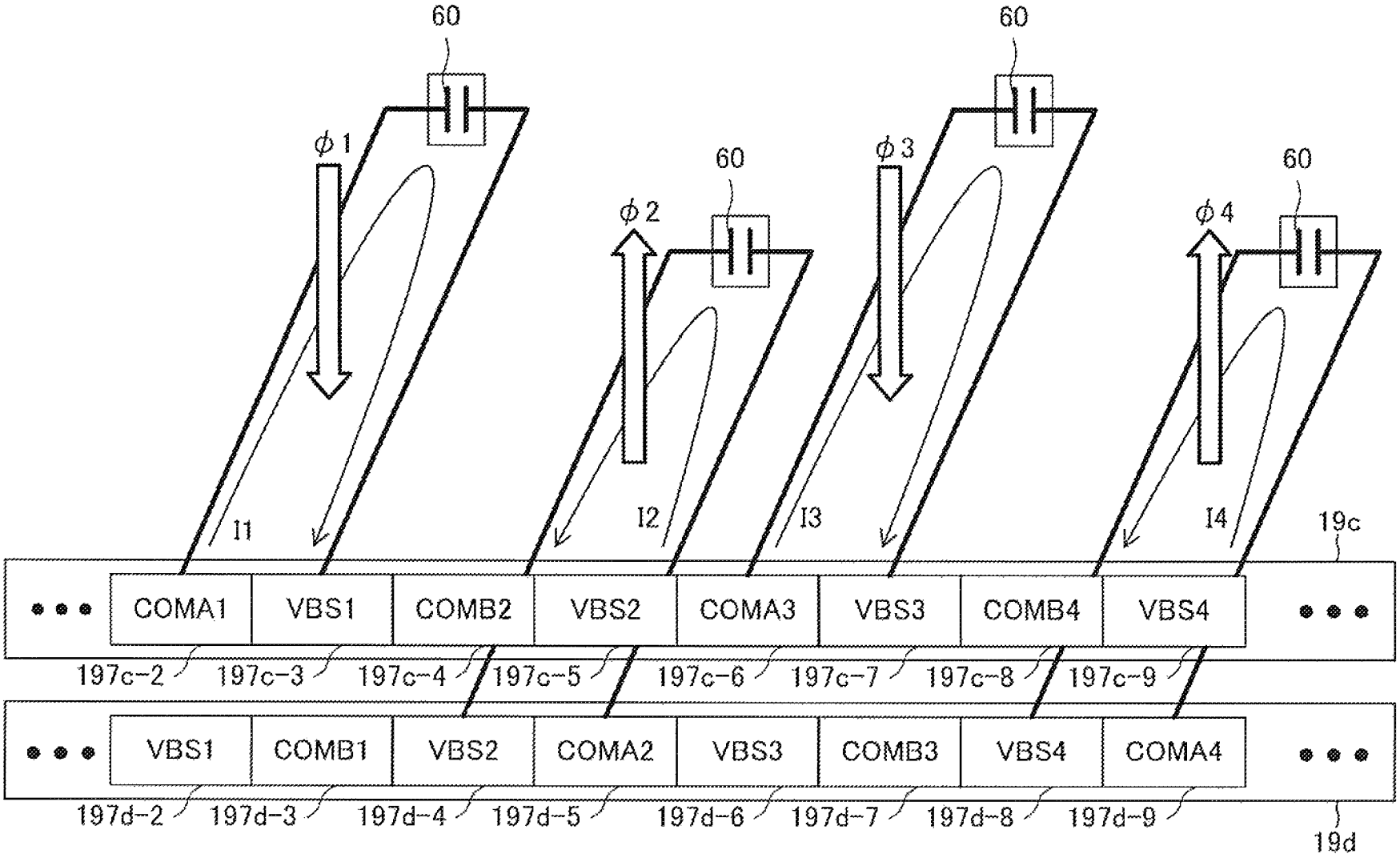
FIG. 18 is a diagram for describing an effect of decrease in mutual inductance.

Furthermore, in the liquid ejecting apparatus 1 in the first embodiment, variations in the voltage value of the overshoot caused by mutual inductance occurring between the wires can be reduced. FIG. 18 is a diagram for describing the effect of decrease in mutual inductance in the first embodiment. In the cable 19*c* illustrated in FIG. 18, a current I1 caused by propagation of the drive signal COMA1 flows in the order of the wire 197*c*-2, the terminal 196*c*-2, the piezoelectric element 60 included in the first nozzle group 660*a*, the terminal 196*c*-3, and the wire 197*c*-3. In the cable 19*d*, a current I2 caused by propagation of the drive signal COMA2 flows in the order of the wire 197*c*-2, the terminal 196*c*-2, the piezoelectric element 60 included in the first nozzle group 660*a*, the terminal 196*c*-3, and the wire 197*c*-3.

In the liquid ejecting apparatus 1 in the first embodiment, in the cables 19*c* and 19*d*, the terminal 196*c*-3 and the terminal 196*d*-4 are disposed between the terminal 196*c*-2 and the terminal 196*d*-5. Accordingly, the path of a current caused by propagation of the drive signal COMA1 is in an opposite direction to the path of a current caused by propagation of the drive signal COMA2. That is, a magnetic flux ϕ1 occurring in the path of a current caused by propagation of the drive signal COMA1 is in an opposite direction to a magnetic flux ϕ2 occurring in the path of a current caused by propagation of the drive signal COMA2. Accordingly, the effect of the magnetic flux on only any wire between different wires is reduced. Thus, variations in inductance component between wires through which the drive signal COMA is propagated can be reduced.

Furthermore, since the magnetic flux occurring in the path of the current caused by propagation of the drive signal COMA1 is in an opposite direction to the magnetic flux occurring in the path of the current caused by propagation of the drive signal COMA2, a change in the magnetic flux in each current path can be promoted. Accordingly, a change in the magnetic flux occurring in each current path is promoted, and a decrease in the current flowing due to the drive signals COMA and COMB is steepened. Therefore, an unnecessary current flowing into the piezoelectric element 60 is reduced, and an overshoot voltage applied to the piezoelectric element 60 can be reduced.

In addition, in the liquid ejecting apparatus 1 in the first embodiment, the terminal 196*d*-3 from which the drive signal COMB1 supplied to the first nozzle group 660*a* is output and the terminal 196*c*-3 from which the reference voltage signal VBS1 is output are disposed at overlapping positions in a plan view. Thus, in the same manner as the case of the drive signal COMA1, a magnetic field caused by currents caused by propagation of the drive signal COMB1 can be reduced, and an overshoot of the drive signal COMB1 can be reduced. Furthermore, the terminal 196*c*-4 from which the drive signal COMB2 supplied to the second nozzle group 660*b* and the terminal 196*d*-4 from which the reference voltage signal VBS2 is output are disposed at overlapping positions in a plan view. Thus, in the same manner as the case of the drive signal COMA2, a magnetic field caused by currents caused by propagation of the drive signal COMB2 can be reduced. Accordingly, even when the drive signal COMB is propagated through the cables 19*c* and 19*d* in addition to the drive signal COMA, the voltage value of an overshoot of the drive signal COMB can be reduced.

1.9 Modification Example

In the liquid ejecting apparatus described above, while the drive signals COMA and COMB generated by the drive circuits 50*a* and 50*b* are divided in the drive circuit substrate 101 and are supplied to the head substrate 104 through the cables 19*c* and 19*d* as the drive signals COMA1 to COMA6 and COMB1 to COMB6, each of the drive signals COMA1 to COMA6 may be short-circuited in the head substrate 104, and each of the drive signals COMB1 to COMB6 may be short-circuited in the head substrate 104.

When the cable group of the first embodiment is applied to the liquid ejecting apparatus 1 having such a configuration, the drive signal COMA output from the drive circuit 50*a* and the drive signal COMB output from the drive circuit 50*b* are propagated through both of the cables 19*c* and 19*d*. Thus, the drive signals COMA and COMB can be supplied to the ejecting head 21 even when a coupling defect occurs in any of the cable 19*c* or the cable 19*d*. Accordingly, even when a coupling defect occurs in any of the cable 19*c* or the cable 19*d*, deterioration of ejecting accuracy can be reduced.

2. Second Embodiment

The liquid ejecting apparatus 1 of a second embodiment has a different configuration from the first embodiment such that any of the cable 19*c* or the cable 19*d* is used in plural number in the cable coupling the drive circuit substrate 101 to the head substrate 104. While a case where two cables 19*c* are used will be described below, the same effect is accomplished when the cables 19*d* are used. In addition, in description of the liquid ejecting apparatus 1 of the second embodiment, the same configuration as the first embodiment will be designated by the same reference sign, and a description of such a configuration will not be repeated.

Specifically, as illustrated in FIG. 15, the cable 19*c* coupling the drive circuit substrate 101 to the ejecting head 21 in the second embodiment includes the terminal 196*c*-2 from which the drive signal COMA1 in the drive signal VOUT1 input into one end of the piezoelectric element 60 included in the first nozzle group 660*a* from the drive circuit 50*a* is output, the terminal 196*c*-4 from which the drive signal COMB2 in the drive signal VOUT2 input into one end of the piezoelectric element 60 included in the second nozzle group 660*b* from the drive circuit 50*b* is output, and the terminal 196*c*-6 from which the drive signal COMA3 in the drive signal VOUT3 input into one end of the piezoelectric element 60 included in the third nozzle group 660*c* from the drive circuit 50*a* is output. The terminal 196*c*-4 is disposed between the terminal 196*c*-2 and the terminal 196*c*-6.

In the liquid ejecting apparatus 1, when the cable 19*c* is used in plural number, an increase in the output of only any of the drive circuits 50*a* and 50*b* can be reduced in the same manner as the first embodiment even when ink mist unevenly clings to any of the plurality of cables 19*c*, since the drive signals COMA and COMB are alternately provided in the cable 19*c* to which the ink mist clings. Accordingly, the possibility of increase in heat emission of a specific drive circuit is reduced.

3. Third Embodiment

Next, the liquid ejecting apparatus 1 in a third embodiment will be described using FIG. 19 to FIG. 21. The liquid ejecting apparatus 1 of the third embodiment is different from the first embodiment in that the cable 19 coupling the drive circuit substrate 101 to the head substrate 104 is electrically coupled by one cable 19*e*. In description of the liquid ejecting apparatus 1 of the third embodiment, the same configuration as the first embodiment will be designated by the same reference sign, and a description of such a configuration will not be repeated.

In the liquid ejecting apparatus 1 of the third embodiment, the cable 19*e* includes a terminal 196*e*-2 from which the drive signal COMA1 in the drive signal VOUT1 input into one end of the piezoelectric element 60 included in the first nozzle group 660*a* from the drive circuit 50*a* is output, a terminal 196*e*-4 from which the drive signal COMB2 in the drive signal VOUT2 input into one end of the piezoelectric element 60 included in the second nozzle group 660*b* from the drive circuit 50*b* is output, a terminal 196*e*-6 from which the drive signal COMA3 in the drive signal VOUT3 input into one end of the piezoelectric element 60 included in the third nozzle group 660*c* from the drive circuit 50*a* is output, a terminal 196*e*-17 from which the drive signal COMB1 in the drive signal VOUT1 input into one end of the piezoelectric element 60 included in the first nozzle group 660*a* from the drive circuit 50*b* is output, a terminal 196*e*-19 from which the drive signal COMA2 in the drive signal VOUT2 input into one end of the piezoelectric element 60 included in the second nozzle group 660*b* from the drive circuit 50*a* is output, a terminal 196*e*-21 from which the drive signal COMB3 in the drive signal VOUT3 input into one end of the piezoelectric element 60 included in the third nozzle group 660*c* from the drive circuit 50*b* is output, a terminal 196*e*-16 from which the reference voltage signal VBS1 input into the other end of the piezoelectric element 60 included in the first nozzle group 660*a* is output, and a terminal 196*e*-18 from which the reference voltage signal VBS2 input into the other end of the piezoelectric element 60 included in the second nozzle group 660*b* is output.

In the cable 19*e*, the terminal 196*e*-4 is disposed between the terminal 196*e*-2 and the terminal 196*e*-6. The terminal 196*e*-19 is disposed between the terminal 196*e*-17 and the terminal 196*e*-21. The terminal 196*e*-18 is disposed between the terminal 196*e*-17 and the terminal 196*e*-19. The terminal 196*e*-17 is disposed between the terminal 196*e*-16 and the terminal 196*e*-18. In a direction orthogonal to a direction in which the terminal 196*e*-2 and the terminal 196*e*-4 are lined up, the terminal 196*e*-2 and the terminal 196*e*-16 are disposed to at least partially overlap with each other, and the terminal 196*e*-4 and the terminal 196*e*-18 are disposed to at least partially overlap with each other.

Details will be described using the drawings. FIG. 19 is a diagram illustrating a state where the cable 19*e* is applied. As illustrated in FIG. 19, the cable 19*e* includes 28 terminals 195*e*, 28 terminals 196*e*, and 28 wires 197. In addition, a cut portion 198 is disposed between a terminal 195*e*-14 and a terminal 195*e*-28 of the cable 19*e*. A cut portion 199 is disposed between a terminal 196*e*-14 and a terminal 196*e*-28. The cable 19*e* is configured by folding the cable 19*e* once or a plurality of times such that terminals 196*e*-1 to 196*e*-14 at least partially overlap with terminals 196*e*-15 to 196*e*-28.

Figure 19:
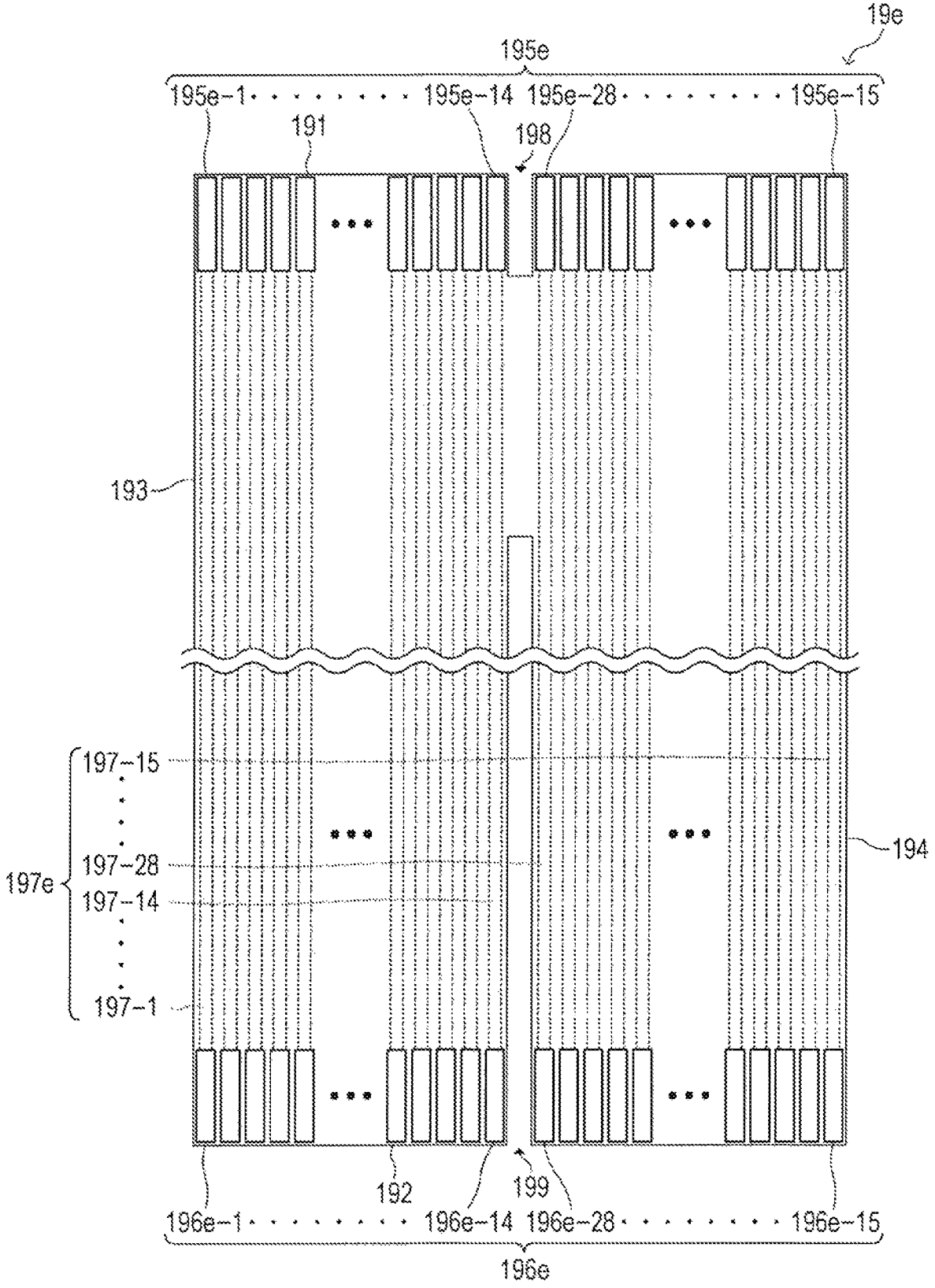
FIG. 19 is a diagram illustrating a state where a cable of a third embodiment is applied.

The same signals as the terminals 195*c*-1 to 195*c*-14, the terminals 196*c*-1 to 196*c*-14, and the wires 197*c*-1 to 197*c*-14 of the cable 19*c* in the first embodiment illustrated in FIG. 16 are propagated through terminals 195*e*-1 to 195*e*-14, the terminals 196*e*-1 to 196*e*-14, and wires 197*e*-1 to 197*e*-14 of the cable 19*e* illustrated in FIG. 19, respectively. For example, the drive signal COMA1 is propagated through the terminal 195*e*-2, the terminal 196*e*-2, and the wire 197*e*-2. In addition, the reference voltage signal VBS1 is propagated through the terminal 195*e*-3, the terminal 196*e*-3, and the wire 197*e*-3. In addition, the drive signal COMB2 is propagated through the terminal 195*e*-4, the terminal 196*e*-4, and the wire 197*e*-4.

The same signals as the terminals 195*d*-1 to 195*d*-14, the terminals 196*d*-1 to 196*d*-14, and the wires 197*d*-1 to 197*d*-14 of the cable 19*d* in the first embodiment illustrated in FIG. 17 are propagated through terminals 195*e*-15 to 195*e*-28, the terminals 196*e*-15 to 196*e*-28, and wires 197*e*-15 to 197*e*-28 of the cable 19*e*, respectively. For example, the drive signal COMB1 is propagated through the terminal 195*e*-17, the terminal 196*e*-17, and the wire 197*e*-17. In addition the reference voltage signal VBS2 is propagated through the terminal 195*e*-18, the terminal 195*e*-18, and the wire 197*e*-18. In addition, the drive signal COMA2 is propagated through the terminal 195*e*-19, the terminal 196*e*-19, and the wire 197*e*-19.

As described above, the cable 19*c* and the cable 19*d* of the first embodiment are configured with one cable as the cable 19*e*. In the cable 19*e* of the liquid ejecting apparatus 1 illustrated in the third embodiment, the terminal 196*e*-2 is one example of the first terminal. The terminal 196*e*-4 is one example of the second terminal. The terminal 196*e*-6 is one example of the third terminal. The terminal 196*e*-17 is one example of the fourth terminal. The terminal 196*e*-19 is one example of the fifth terminal. The terminal 196*e*-21 is one example of the sixth terminal. The terminal 196*e*-16 is one example of the seventh terminal. The terminal 196*e*-18 is one example of the eighth terminal.

Figure 20:
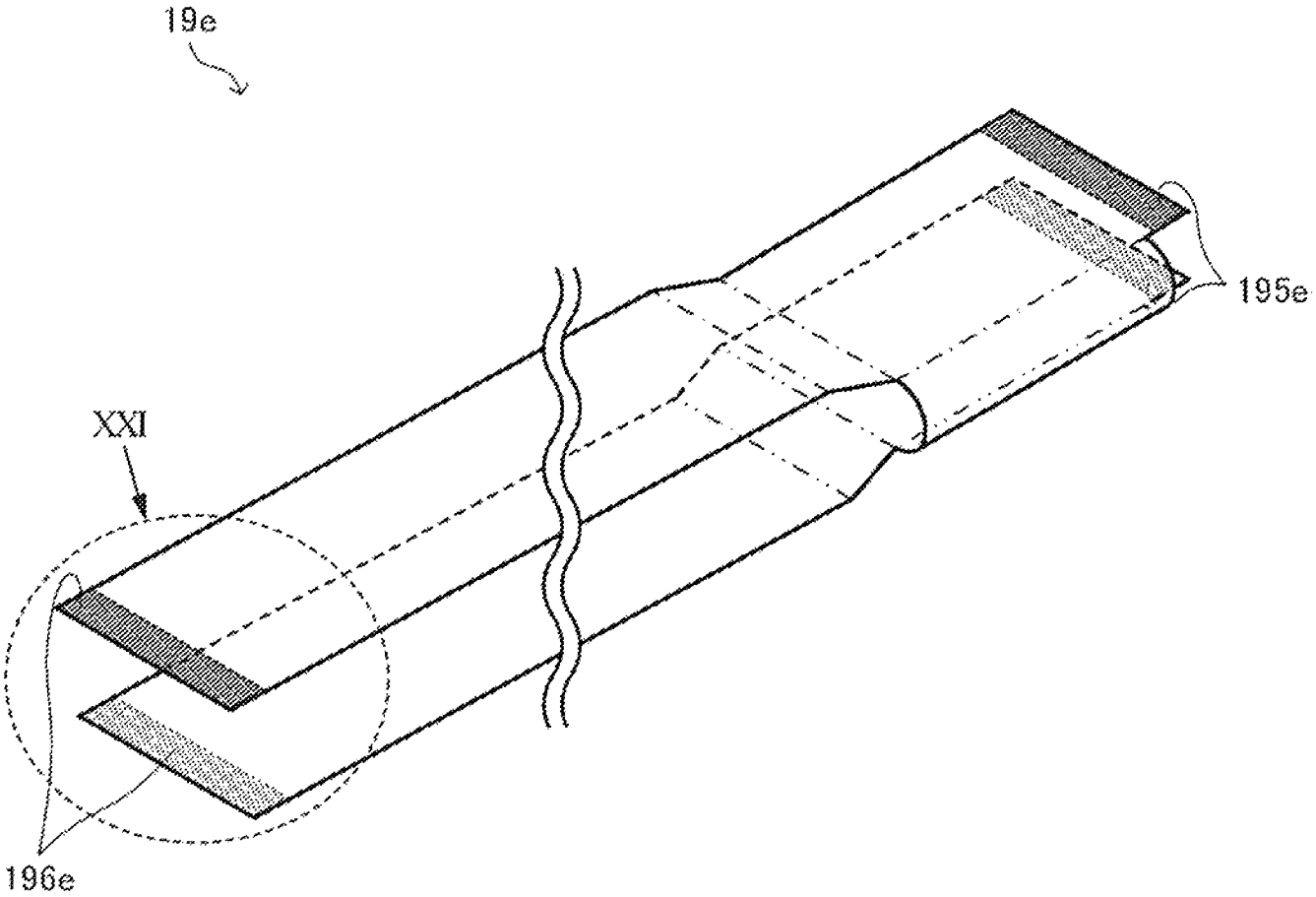
FIG. 20 is a diagram illustrating one example of a state where the cable of the third embodiment is folded.

FIG. 20 is a diagram illustrating one example of a state where the cable 19*e* is folded such that the terminals 196*e*-1 to 196*e*-14 at least partially overlap with the terminals 196*e*-15 to 196*e*-28. The liquid ejecting apparatus 1 in the third embodiment will be described using one example of a case where the cable 19*e* is folded once toward the outside of the plurality of terminals 195*e* and 196*e* in the cut portions 198 and 199.

Figure 21:
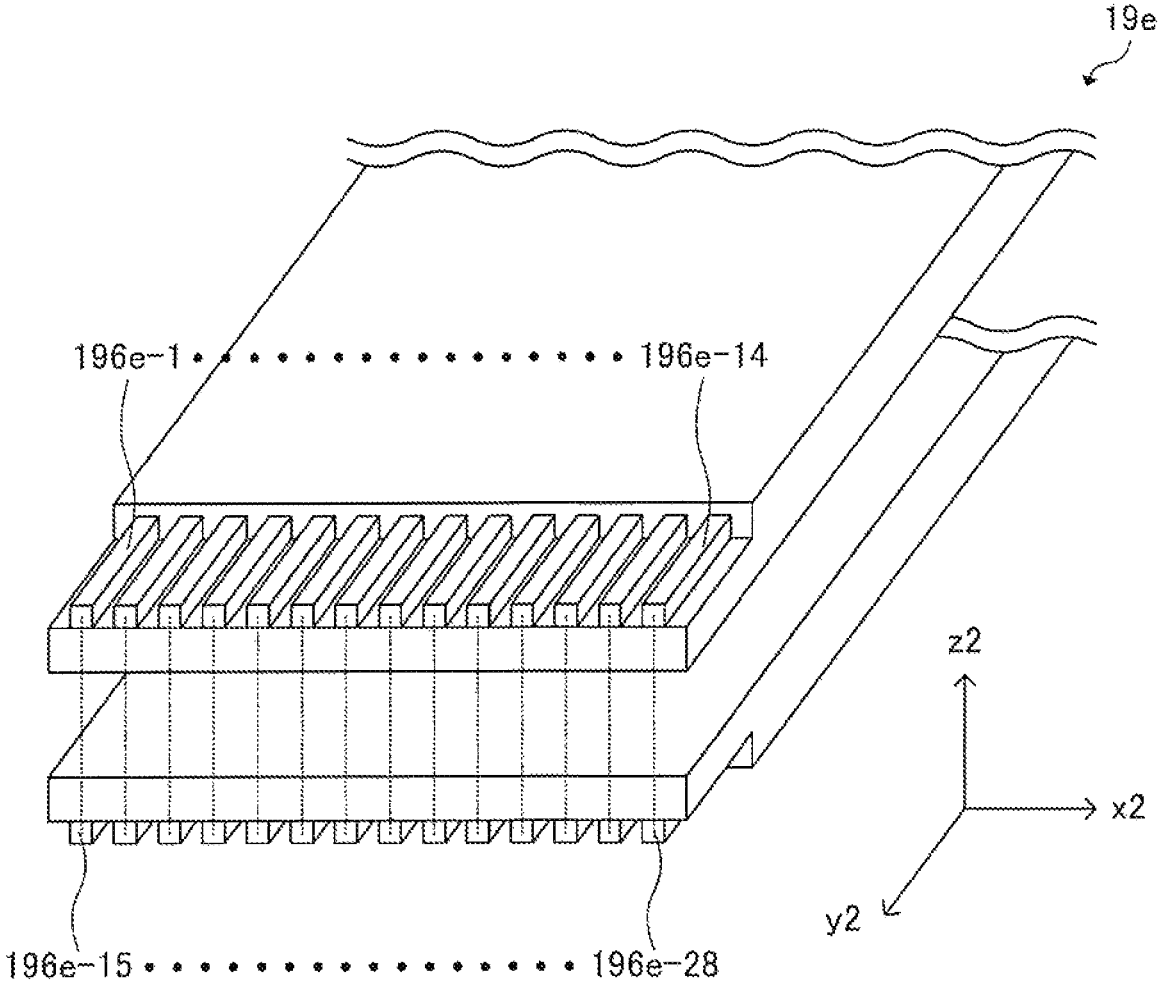
FIG. 21 is an enlarged diagram of part XXI in FIG. 20.

FIG. 21 is an enlarged diagram of part XXI in FIG. 20. In addition, directions x2, y2, and z2 that are orthogonal to each other are illustrated in FIG. 21. As illustrated in FIG. 21, the terminals 196*e*-1 to 196*e*-14 in the end portion of the cable 19*e* are linearly disposed in the direction x2. In addition, the terminals 196*e*-15 to 196*e*-28 are linearly disposed in the direction x2.

In the direction z2 orthogonal to the direction x2 in which the terminals 196*e*-1 to 196*e*-14 are lined up, the terminals 196*e*-1 to 196*e*-14 are respectively disposed in an overlapping manner with the terminals 196*e*-15 to 196*e*-28. In other words, the terminals 196*e*-1 to 196*e*-14 are respectively disposed in an overlapping manner with the terminals 196*e*-15 to 196*e*-28 in a plan view. Specifically, a terminal 196*e*-*j* (j is any of 1 to 14) and a terminal 196*e*-*j*+14 are disposed in an overlapping manner in a plan view.

As described above, by folding the cable 19*e* such that the terminal 196*e*-*j* (j is any of 1 to 14) and the terminal 196*e*-*j*+14 overlap in a plan view, the same operation effect as the liquid ejecting apparatus 1 of the first embodiment can be acquired in the liquid ejecting apparatus 1 of the third embodiment.

The cable 19*e* is not limited to the form illustrated in FIG. 20, provided that the cable 19*e* is folded such that the terminal 196*e*-*j* (j is any of 1 to 14) and the terminal 196*e*-*j*+14 overlap in a plan view.

While the embodiments and the modification example are described thus far, the present disclosure is not limited to the embodiments and can be embodied in various aspects without departing from its nature. For example, the embodiments can be appropriately combined.

The present disclosure includes substantially the same configuration as the configuration described in the embodiments (for example, a configuration having the same function, method, and result or a configuration having the same application and effect). In addition, the present disclosure includes a configuration acquired by replacing a non-substantial part of the configuration described in the embodiments. In addition, the present disclosure includes a configuration that can achieve the same operation effect or the same application as the configuration described in the embodiments. In addition, the present disclosure includes a configuration acquired by adding a well-known technology to the configuration described in the embodiments.

What is claimed is:

1. A cable group electrically coupled to an ejecting head of a liquid ejecting apparatus, the ejecting head including a first ejecting unit ejecting a liquid by driving a first piezoelectric element, a second ejecting unit ejecting a liquid by driving a second piezoelectric element, and a third ejecting unit ejecting a liquid by driving a third piezoelectric element, the cable group comprising:

a first cable including a first terminal from which a first drive signal input into one end of the first piezoelectric element from a first drive circuit is output, a second terminal from which a second drive signal input into one end of the second piezoelectric element from a second drive circuit is output, and a third terminal from which a third drive signal input into one end of the third piezoelectric element from the first drive circuit is output; and a second cable including a fourth terminal from which a fourth drive signal input into one end of the first piezoelectric element from the second drive circuit is output, a fifth terminal from which a fifth drive signal input into one end of the second piezoelectric element from the first drive circuit is output, and a sixth terminal from which a sixth drive signal input into one end of the third piezoelectric element from the second drive circuit is output, wherein the second terminal is disposed between the first terminal and the third terminal, the fifth terminal is disposed between the fourth terminal and the sixth terminal, and the first cable and the second cable are disposed to at least partially overlap with each other in a direction orthogonal to a direction in which the first terminal and the second terminal are lined up.

2. The cable group according to claim 1, wherein the second cable includes a seventh terminal from which a first reference voltage signal input into another end of the first piezoelectric element is output, and an eighth terminal from which a second reference voltage signal input into another end of the second piezoelectric element is output, the eighth terminal is disposed between the fourth terminal and the fifth terminal, the fourth terminal is disposed between the seventh terminal and the eighth terminal, and the first cable and the second cable are disposed such that the first terminal and the seventh terminal at least partially overlap with each other, and the second terminal and the eighth terminal at least partially overlap with each other.

3. The cable group according to claim 1, wherein the first drive signal and the second drive signal have different signal waveforms.

4. The cable group according to claim 3, wherein a maximum voltage of the first drive signal is higher than a maximum voltage of the second drive signal.

5. A cable coupled to an ejecting head of a liquid ejecting apparatus, the ejecting head including a first ejecting unit ejecting a liquid by driving a first piezoelectric element, a second ejecting unit ejecting a liquid by driving a second piezoelectric element, and a third ejecting unit ejecting a liquid by driving a third piezoelectric element, the cable comprising:

a first terminal from which a first drive signal input into one end of the first piezoelectric element from a first drive circuit is output;

a second terminal from which a second drive signal input into one end of the second piezoelectric element from a second drive circuit is output; and a third terminal from which a third drive signal input into one end of the third piezoelectric element from the first drive circuit is output, wherein the second terminal is disposed between the first terminal and the third terminal.

6. The cable according to claim 5, further comprising:

a fourth terminal from which a fourth drive signal input into one end of the first piezoelectric element from the second drive circuit is output;

a fifth terminal from which a fifth drive signal input into one end of the second piezoelectric element from the first drive circuit is output;

a sixth terminal from which a sixth drive signal input into one end of the third piezoelectric element from the second drive circuit is output;

a seventh terminal from which a first reference voltage signal input into another end of the first piezoelectric element is output; and an eighth terminal from which a second reference voltage signal input into another end of the second piezoelectric element is output, wherein the fifth terminal is disposed between the fourth terminal and the sixth terminal, the eighth terminal is disposed between the fourth terminal and the fifth terminal, the fourth terminal is disposed between the seventh terminal and the eighth terminal, and in a direction orthogonal to a direction in which the first terminal and the second terminal are lined up, the first terminal and the seventh terminal are disposed to at least partially overlap with each other, and the second terminal and the eighth terminal are disposed to at least partially overlap with each other.

* * * * *